US006367905B1

(12) United States Patent
Sharma et al.

(10) Patent No.: US 6,367,905 B1
(45) Date of Patent: Apr. 9, 2002

(54) PRINT HEAD CLEANING ASSEMBLY WITH ROLLER AND METHOD FOR AN INK JET PRINT HEAD WITH FIXED GUTTER

(75) Inventors: Ravi Sharma, Fairport; Todd R. Griffin, Rochester; Charles F. Faisst, Avon, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/590,988

(22) Filed: Jun. 9, 2000

(51) Int. Cl.[7] ..... B41J 2/165
(52) U.S. Cl. ..... 347/33
(58) Field of Search ..... 347/33, 22, 23, 347/28, 82, 90, 89

(56) References Cited

U.S. PATENT DOCUMENTS 4,437,101 A * 3/1984 Ebi et al. ..... 347/90
4,667,207 A * 5/1987 Sutera et al. ..... 347/90
4,757,328 A * 7/1988 Braun et al. ..... 347/90
4,800,403 A 1/1989 Acattino et al.
4,829,318 A 5/1989 Racicot et al.
4,839,664 A * 6/1989 Archer et al. ..... 347/90
4,968,994 A 11/1990 Hock et al.
4,994,821 A * 2/1991 Fagerquist ..... 347/90
5,337,071 A * 8/1994 East et al. ..... 347/90
5,614,930 A 3/1997 Osborne et al.
6,079,821 A * 6/2000 Chwalek et al. ..... 347/82
6,234,620 B1 * 5/2001 Faisst, Jr. et al. ..... 347/90

* cited by examiner

*Primary Examiner*—Huan Tran
(74) *Attorney, Agent, or Firm*—Walter S. Stevens

(57) ABSTRACT

A self-cleaning printer system (400) with cleaning liquid supply (270) and print head cleaning assembly (32) and method of assembling a self-cleaning printer. The printer system (400) comprises a print head (16) defining a plurality of ink channels therein, each ink channel terminating in one or more ink ejection nozzles (25). The print head (16) also has a surface (15) thereon surrounding all the nozzles (25). Contaminant may reside on the surface (15) and also may completely or partially obstruct one or more of the nozzles (25). Therefore, the print head cleaning assembly (32) includes a roller (190) disposed relative to the surface (15) and/or nozzles (25) for cleaning the surface (15) and/or the nozzles (25). A cleaning assembly control (40) directs sliding contact of the roller (190) with the surface (15) and/or nozzles (25). The print head cleaning assembly (32) is configured to introduce cleaning liquid (300) to the print head surface (15) to facilitate and augment cleaning by the roller (190). In addition, the roller (190) is combined with channels (250, 260) for delivery and suction of cleaning liquid (300).

29 Claims, 19 Drawing Sheets

PRINT HEAD CLEANING ASSEMBLY WITH ROLLER AND METHOD FOR AN INK JET PRINT HEAD WITH FIXED GUTTER

FIELD OF THE INVENTION

This invention generally relates to a self-cleaning ink jet printer and methods for cleaning the same, and more particularly to a print head cleaning assembly including a roller for use in cleaning the print head surface and ink nozzles for an ink jet printer having a fixed canopy-type gutter.

BACKGROUND OF THE INVENTION

An ink jet printer produces images by ejecting ink droplets onto a receiver medium in an image-wise fashion. The advantages of non-impact, low-noise, low energy use, and low cost operation in addition to the capability of the printer to print on plain paper mediums are largely responsible for the wide acceptance of ink jet printers in the marketplace.

"On demand" ink jet printers utilize a pressurization actuator to produce the ink jet droplet at orifices of a print head. In this regard, either one of two types of actuators may be used including heat actuators and piezoelectric actuators. With heat actuators, a heater placed at a convenient location heats the ink and a quantity of the ink will phase change into a gaseous steam bubble and raise the internal ink pressure sufficiently for an ink droplet to be expelled onto the recording medium. With piezoelectric actuators, a piezoelectric material possessing properties such that an electric field is produced when a mechanical stress is applied. The converse also holds true; that is, an applied electric field will produce a mechanical stress in the material. Some naturally occurring materials possessing these characteristics are quartz and tourmaline. The most commonly produced piezoelectric ceramics are lead zirconate titanate, barium titanate, lead titanate, and lead metaniobate.

In the case of "continuous" ink jet printers, electrostatic charging tunnels are placed close to the point where ink droplets are being ejected in the form of a stream. Selected droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the recording medium.

Recently a new type of continuous ink jet printer has been disclosed. U.S. Pat. No. 6,079,821 which issued to Chwalek et al. on Jun. 27, 2000, describes a continuous ink jet printer in which on demand asymmetric heating of an ink jet causes selected drops to deflect. In one mode of operation, selected drops are deflected toward an image-recording medium while the other drops are intercepted in a canopy-type gutter that is placed in close proximity (for example, 3 mm) to an ink jet nozzle plate.

Inks for high-speed inkjet printers, whether of the "continuous" or "piezoelectric" type, must have a number of special characteristics. For example, the ink should incorporate a nondrying characteristic, so that drying of ink in the ink ejection chamber is hindered or slowed to such a state that by occasional spitting of ink droplets, the cavities and corresponding nozzles are kept open. The addition of glycol facilitates free flow of ink through the ink jet chamber. Of course, the ink jet print head is exposed to the environment where the ink jet printing occurs. Thus, the previously mentioned nozzles are exposed to many kinds of air born particulates. Particulate debris may accumulate on surfaces formed around the nozzles and may accumulate in the nozzles and chambers themselves. That is, the ink may combine with such particulate debris to form an interference that blocks the nozzle or that altars surface wetting to inhibit proper formation of the ink droplet. The particulate debris should be cleaned from the surface and nozzle to restore proper droplet formation. In the prior art, this cleaning is commonly accomplished by brushing, wiping, spraying, vacuum suction, and/or spitting of ink through the nozzle.

Thus, ink jet printers can be said to have the following problems: the inks tend to dry-out in and around the nozzles resulting in clogging of the nozzles; and the wiping of the nozzle plate causes wear on plate and wiper, the wiper itself producing particles that clog the nozzle. In addition, cleaning an ink jet nozzle plate that has limited accessibility due to the placement of a fixed gutter poses extra demands on the design of cleaning members and on methods used.

Ink jet print head cleaners are known. For example, a print head wiping system for inkjet print heads is disclosed in U.S. Pat. No. 5,614,930, entitled "Orthogonal Rotary Wiping System For Inkjet Printheads" issued Mar. 25, 1997 in the name of William S. Osborne et al. The Osborne et al. patent discloses a rotary service station, which incorporates a wiper-supporting tumbler. The tumbler rotates to wipe the print head along a length of a linearly aligned nozzle. In addition, a wiper scraping system scrapes the wipers to clean the wipers. However, Osborne et al. do not disclose use of an external solvent to assist cleaning and also does not disclose complete removal of the external solvent. In addition, a wiper scraping system is limited by the size constraints imposed by the print head itself. This is particularly true for fixed gutter inkjet print head systems, which partially encloses the print head surfaces. Fixed gutter systems require a mechanism that can work within small tolerances imposed by the integrated gutter in order to clean the print head. The Osborne et al. cannot tolerate the stresses demanded by the tight spacing and limited size of current ink jet print heads.

Therefore, there is a need to provide a suitable ink jet printer with a cleaning mechanism, and method of assembling the same, wherein the cleaning mechanism is capable of cleaning the print head surface within the confines of small tolerances and limited spacing. There is also a need to supply cleaning liquid to lubricate and aid cleaning in a manner that does not cause wear of the print head nozzle plate. Furthermore, there is a need for a cleaning mechanism that can operate within the limited spacing imposed by a fixed canopy-type gutter.

SUMMARY OF THE INVENTION

It is an object of the present invention to provide a self-cleaning ink jet printer with a cleaning mechanism and method of assembling the same, wherein a surface of a print head belonging to the printer is effectively cleaned.

It is another object of the present invention to provide an ink jet print head assembly that includes a cleaning mechanism and method of assembling the same that can be utilized in fixed gutter continuous ink jet printers.

With the above objects in view, disclosed is a cleaning mechanism composed of a print head cleaning assembly for use in a self-cleaning printer. The self-cleaning printer includes a print head having a print head surface and an ink channel therein, and a structural member that functions as a gutter for collecting ink disposed opposite to the print head surface. The cleaning mechanism is adapted to clean contaminant from the print head surface.

According to an exemplary embodiment of the present invention, a self-cleaning printer is disclosed, wherein the self-cleaning printer includes a print head defining a plurality of ink channels therein, each ink channel terminating in a nozzle. The print head also has a surface thereon surrounding all the nozzles. The print head is capable of letting ink through the nozzles, such that ink jets are subsequently heated to cause ink drops to form and to selectively deviate for printing. Ink drops are intercepted by either a receiver medium, such as paper, or a gutter. In one method of operation, ink is selectively deflected onto a receiver supported by a platen disposed adjacent the print head, while the non-deflected ink drops are intercepted by the gutter.

Ink intercepted by the gutter may be recycled. Contaminant such as an oily film-like deposit or particulate matter may reside on the surface and may completely or partially obstruct the nozzle. The oily film may be, for example, grease and the particulate matter may be particles of dirt, dust, metal and/or encrustations of dried ink. Presence of the contaminant interferes with proper ejection of the ink droplets from their respective nozzles and therefore may give rise to undesirable image artifacts, such as banding. It is therefore desirable to clean the contaminant from the surface and the nozzles.

Therefore, a cleaning mechanism is disposed relative to the surface and/or the nozzles so as to direct a print head cleaning assembly to clean the contaminant from the surface and/or nozzle via contact with a roller. As described in detail herein, the cleaning mechanism is configured to introduce cleaning liquid to the print head cleaning assembly to facilitate and augment cleaning by the roller. In one embodiment, the roller comprises a rotating shaft surrounded by a covering made of a sponge-like porous material. A driver connected and/or integrated with the rotating shaft provides the movement of the roller. The driver is driven by a motor.

In a preferred embodiment, cleaning liquid is supplied to the print head surface through channels provided in the gutter. The sponge-like material assists the contaminants in adhering to the roller during the back and forth movement of the roller across the print head surface.

A feature of the present invention is the provision of a mechanism to align and transport the roller during cleaning operation.

Another feature of the present invention is the provision of an ultrasonic transducer to energize the cleaning action by the roller and the cleaning liquid.

A technical advantage of the present invention is that the cleaning mechanism belonging to the invention cleans the contaminant from the surface and/or nozzle(s) in the confined space between the print head surface and the fixed gutter.

These and other objects, features and advantages of the present invention will become apparent to those skilled in the art upon a reading of the following detailed description taken in conjunction with the appended drawings, which show and describe illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description taken in conjunction with the accompanying drawings wherein:

Figure 1A:
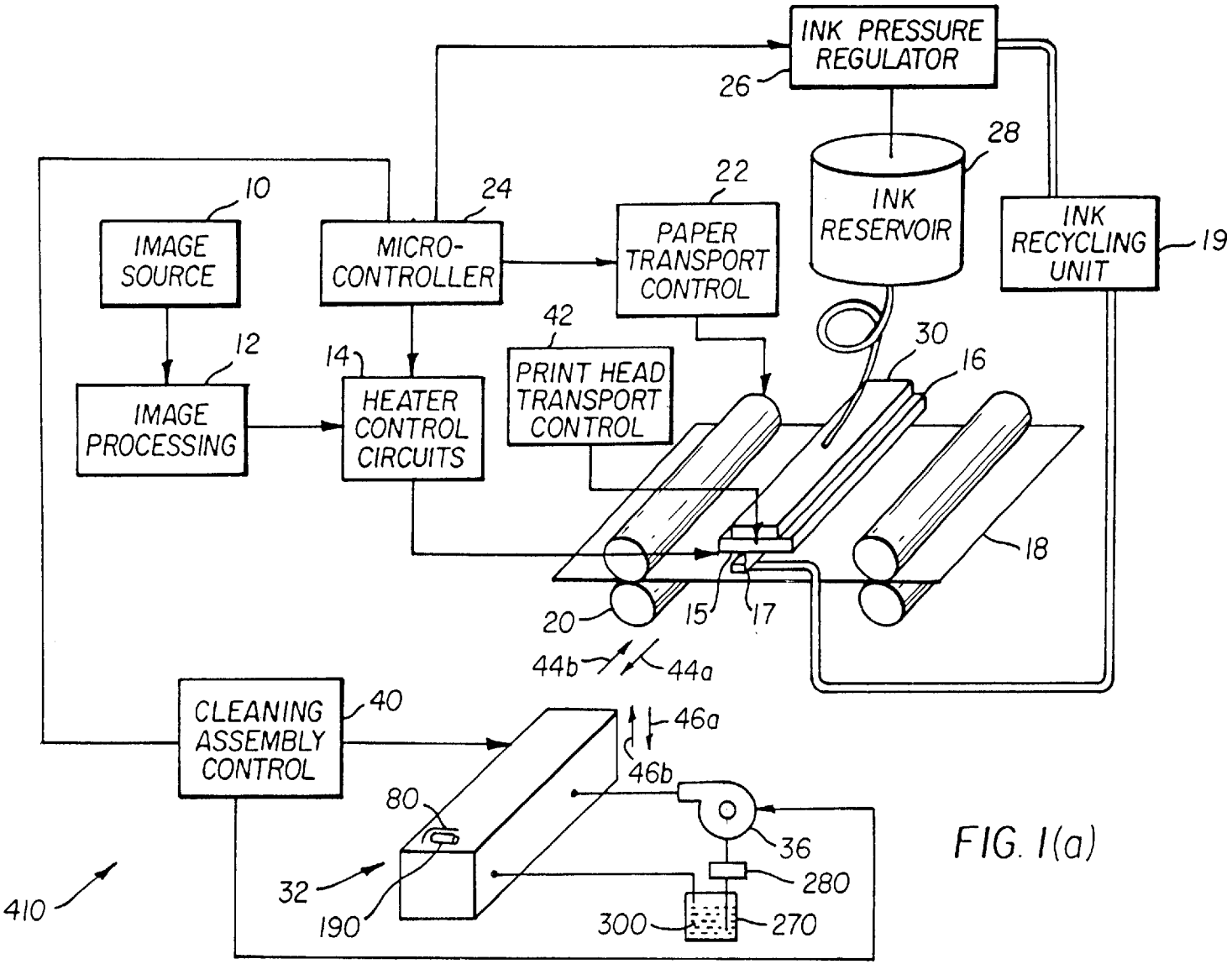
FIG. 1A shows a simplified block schematic diagram of a first embodiment printer equipped with a page width print head with fixed gutter and cleaning mechanism disposed adjacent to the print head.

Numerals and parts in the detailed description correspond to like references in the figures unless otherwise indicated.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Therefore, referring to FIGS. 1A, 1B, 2 and 3 therein are shown first and second embodiments denoted generally as 410 and 420, respectively, for self-cleaning printer systems which include an image source 10, such as a scanner or a computer that provides raster image data, outline image data in the form of a page description language, or other forms of digital image data. The image source 10 is converted to half-toned bitmap image data by an image-processing unit 12, which stores the image data in memory. A plurality of heater control circuits 14 read the data from memory within the image-processing unit 12 and apply time-varying electrical pulses to a set of nozzle heaters 50 that are part of a print head 16.

Figure 3:
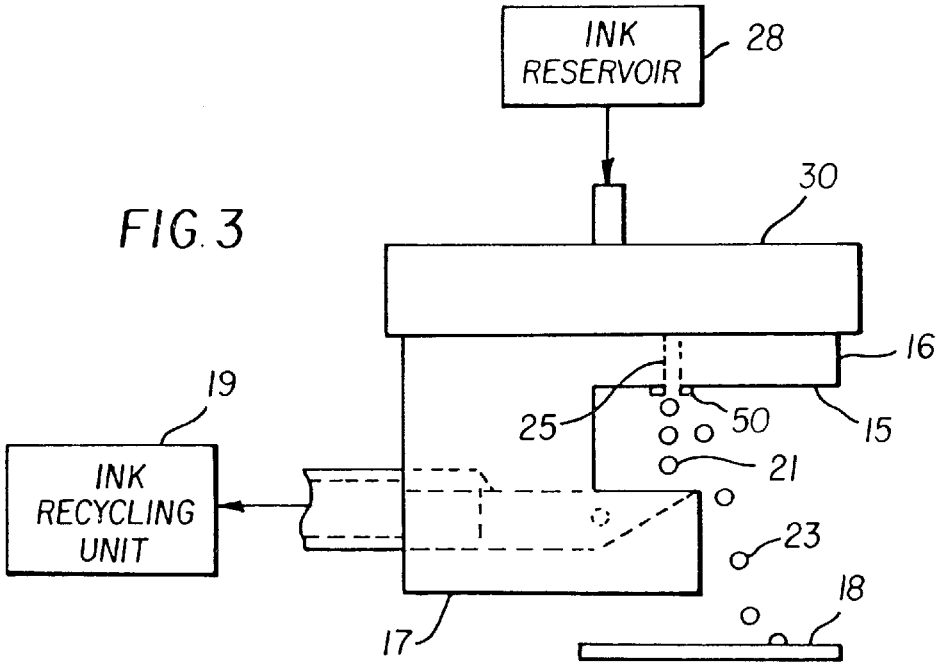
FIG. 3 is a side view of a print head according to the invention, showing deflected ink drops directed toward a receiving medium and non-deflected ink drops intercepted by the fixed gutter.

The action of the nozzle heaters 50 and print head 16 during printing is shown in FIG. 3 wherein the electrical pulses are applied at an appropriate time, and to the appropriate nozzle, so that drops 23 form a continuous ink jet stream to create spots on a recording medium 18, typically paper, in an appropriate position designated by the data in the memory of the image processing unit 12. Non-deflected ink drops 21 formed in the non-printing area are intercepted by the gutter 17, which, as shown, is fixed in relation to the print head 16. Print head 16 may be a page width print head or a scanning type print head.

Figure 1B:
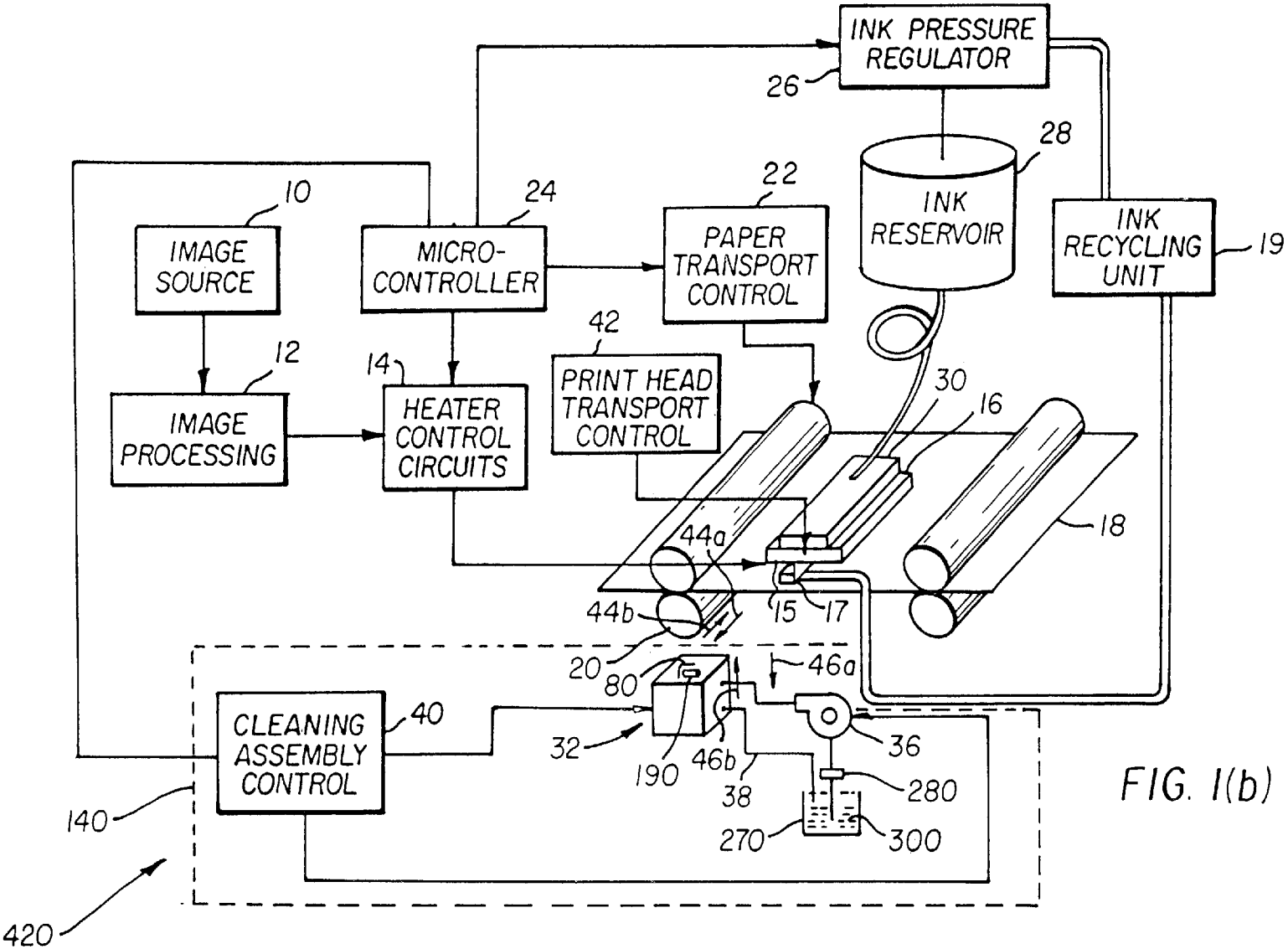
FIG. 1B shows a simplified block schematic diagram of a second embodiment printer the printer equipped with a scanning print head with fixed gutter and cleaning mechanism disposed adjacent to the print head.

Referring to FIG. 1A and FIG. 1B, recording medium 18 is moved relative to the print head 16 by a recording medium transport system 20, which is electronically controlled by a paper transport control system 22, and which, in turn, is controlled by a micro-controller 24. The paper medium transport control system 22 shown in FIG. 1A and FIG. 1B is shown in schematic form only, and many different mechanical configurations are possible, as is known to those of skill in the art. For example, a transfer roller could be used as a paper medium transport system 22 to facilitate transfer of the ink drops 23 to recording medium 18. Such transfer roller technology is well known in the art. In the case of page width print heads, it is most convenient to move the recording medium 18 past a stationary print head. However, in the case of a scanning print system (as shown schematically in FIG. 1B), it is usually most convenient to move the print head along one axis (the sub-scanning direction) and the recording medium 18 along an orthogonal axis (the main scanning direction) in a relative raster motion.

Referring to FIGS. 1A, 1B, 3 and 4, ink is contained in an ink reservoir 28 under pressure. In the non printing state, continuous ink jet drop streams are unable to reach the recording medium 18 due to the position of gutter 17 that blocks the stream of ink to allow a portion of the ink to be recycled by an ink recycling unit 19. The ink-recycling unit 19 reconditions the ink and feeds it back to ink reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

Figure 2:
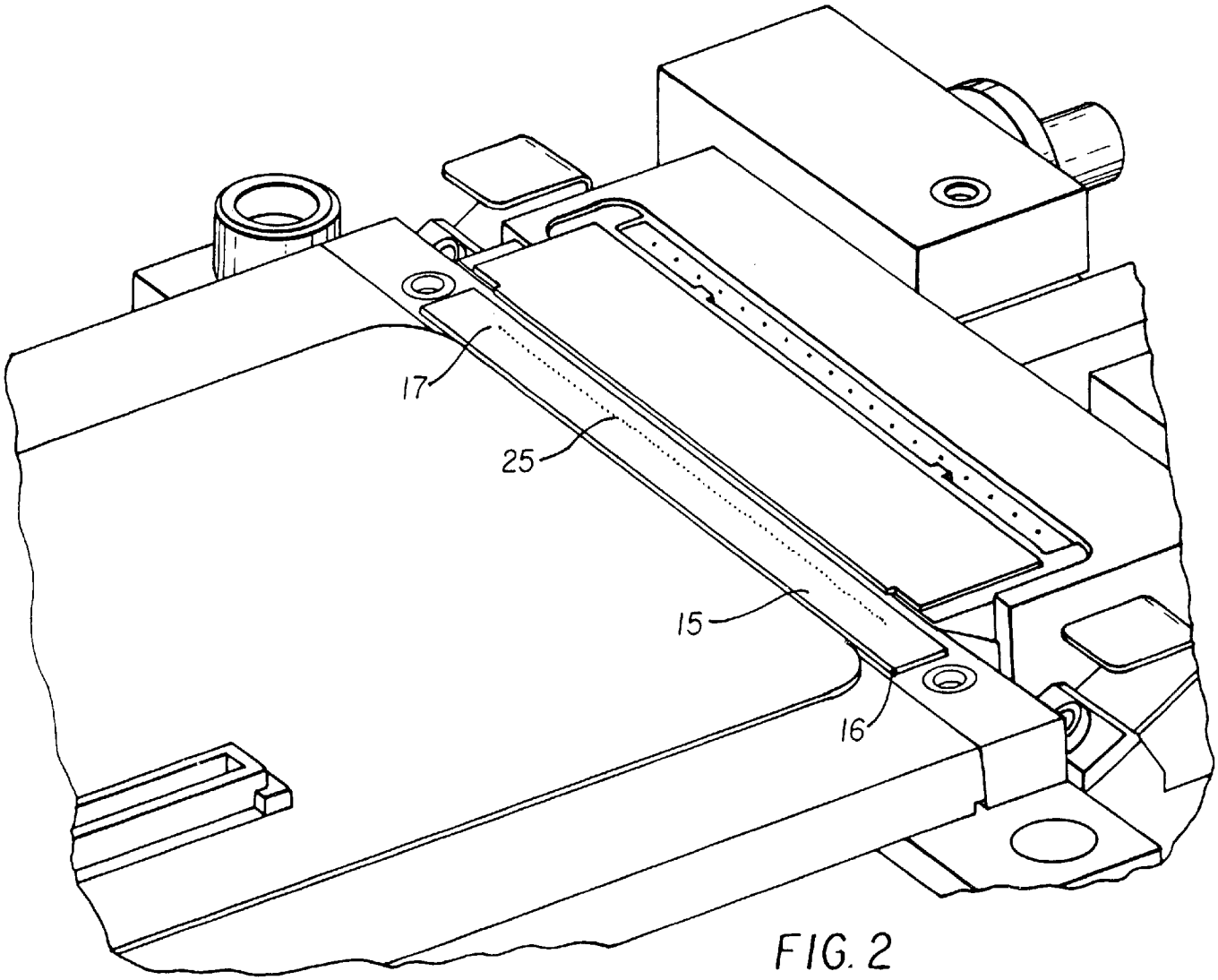
FIG. 2 is an isotopic view of the print head with fixed gutter, the print head defining a plurality of channels therein, each channel terminating in a nozzle.
Figure 4:
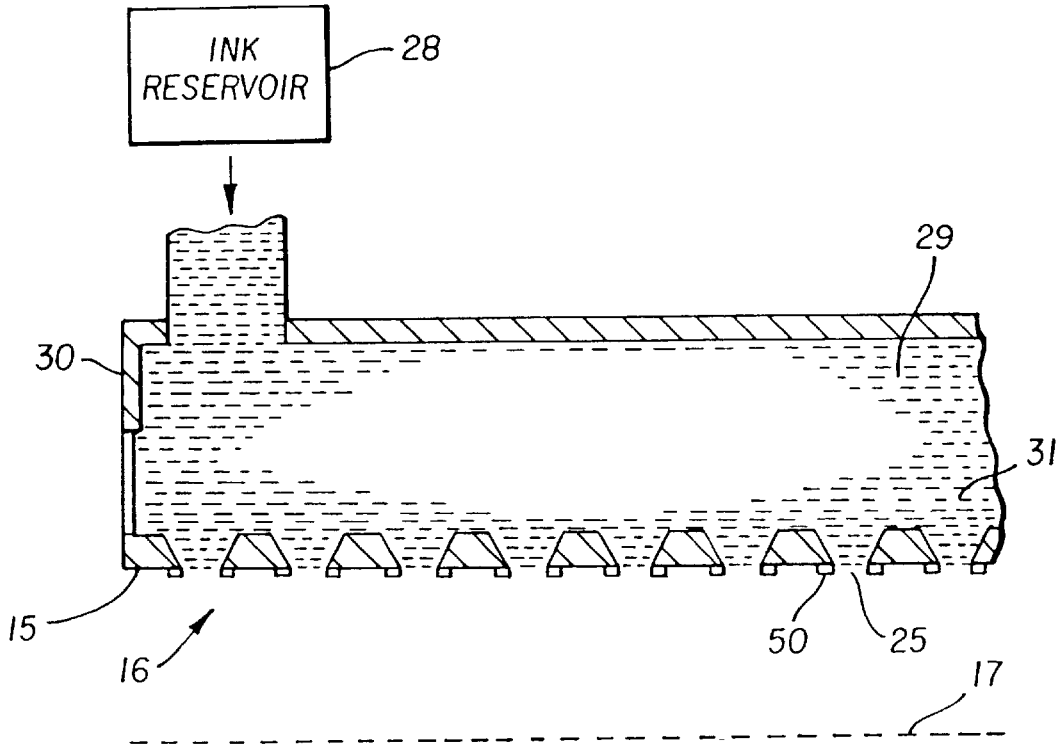
FIG. 4 is a fragmented view in cross-section of the print head shown in FIG. 3.

Ink 29 is distributed to the back surface of the print head 16 by an ink channel device 30 and through ink channel 31, as shown in FIG. 4. The ink preferably flows through slots and/or holes etched through silicon substrate of print head 16 to its front surface 15, where a plurality of nozzles 25 and heaters 50 are situated. FIG. 2 is an isotropic view of the print head 16 and gutter 17. With print head 16 fabricated from silicon, it is possible to integrate heater control circuits 14 with the print head 16. Gutter 17 intercepts non-deflected ink drops 21, while deflected ink drops 23 land on the recording medium 18. Deflection may be caused by a variety of methods including the asymmetric heating method discussed in U.S. Pat. No. 6,079,821.

Figure 5:
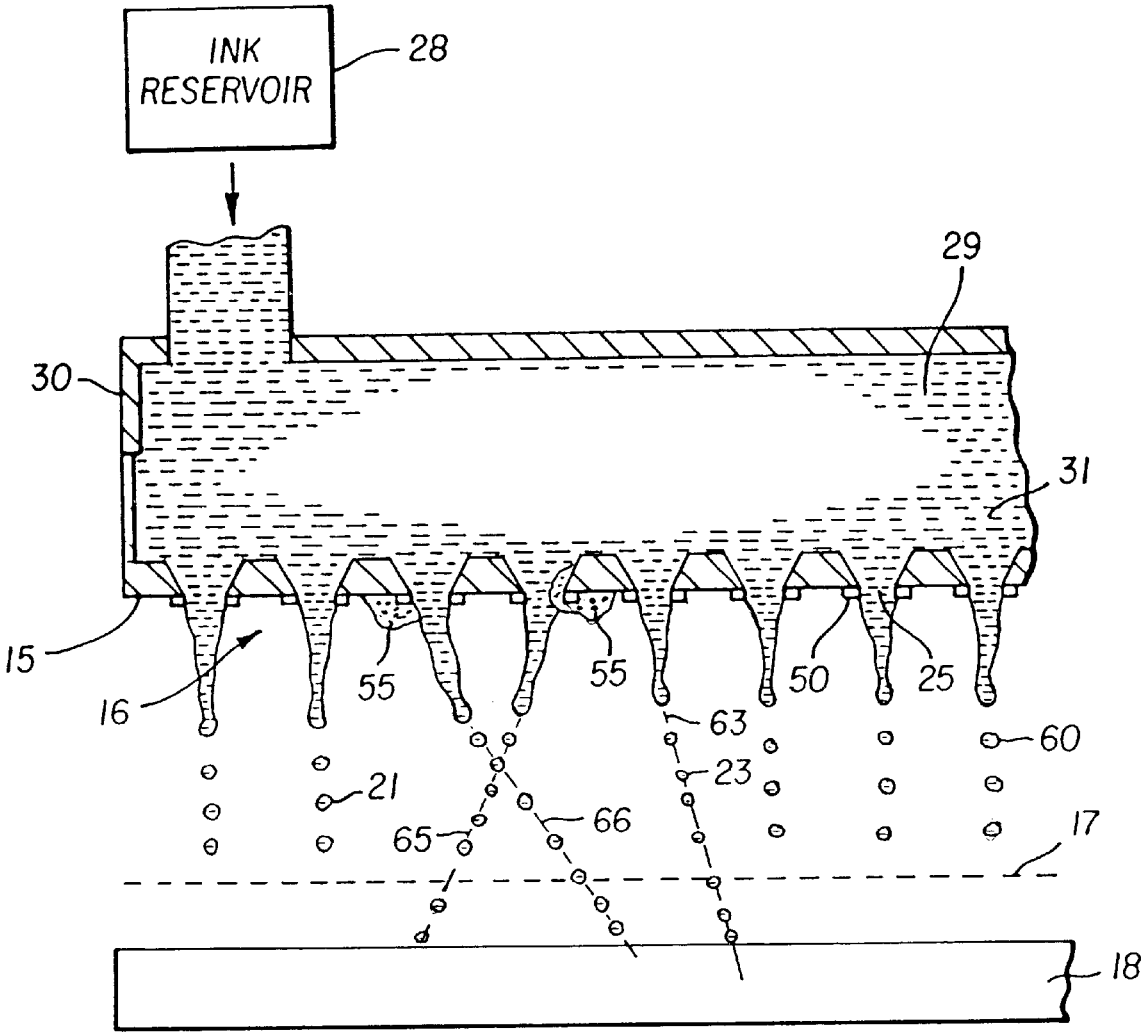
FIG. 5 is a fragmented view in cross-section of a contaminated print head with schematic representation of misaligned ink drops due to contaminant.

Turning now to FIG. 5, it has been observed that the front surface 15 may become fouled by contaminant 55. Contaminant 55 may be, for example, an oily film or particulate matter residing on the front surface 15. Contaminant 55 also may partially or completely obstructs one or more of the plurality of nozzles 25. The particulate matter may be, for example, particles of dirt, dust, metal and/or encrustations of dried ink. The oily film may be, for example, grease or the like. Presence of contaminant 55 is undesirable because when contaminant 55 completely obstruct one or more of the plurality of nozzles 25, ink is prevented from being ejected from one or more of the nozzles 25. It should be understood that the terms "nozzle" and "nozzles" are used interchangeably throughout either in the singular or plural as may be appropriate.

In addition, when contaminant 55 partially obstructs nozzle 25, flight of ink droplets 60 may be diverted from first axis 63 to travel along a second axis 65 (as shown). If ink droplets 60 travels along second axis 65, ink droplets 60 will land on recording medium 18 in an unintended location. In this manner, such complete or partial obstruction of nozzle 25 leads to printing artifacts such as "banding", a highly undesirable result. A similar printing artifact results if non-selected drops 21 travel on third axis 66. Also, the presence of contaminant 55 may alter surface wetting and inhibit proper formation of a droplets 60. Therefore, it is desirable to clean and/or contaminant 55 to avoid these and other printing artifacts.

Therefore, the self-cleaning printer systems 410 and 420 are equipped with a cleaning mechanism 140 that can be used for simultaneously removing contaminant 55 from front surface 15 of the print head 16 and the nozzles 25, according to the invention. In particular, the self-cleaning printer system 410 of FIG. 1A refers to a page width print head, while self-cleaning printer system 420 of FIG. 1B refers to a scanning type print head. The cleaning mechanism 140 includes a print head cleaning assembly 32, disposed for directing flow of cleaning liquid 300 using a roller 190 that moves along the front surface 15 and across nozzles 25 to clean contaminant 55 therefrom. The cleaning liquid 300 mentioned hereinabove may be any suitable liquid solvent composition, such as water, ink, isopropanol, diethylene glycol, diethylene glycol monobutyl ether, octane, acids and bases, surfactant solutions and any combination thereof. Complex liquid compositions may also be used, such as microemulsions, micellar surfactant solutions, vesicles and solid particles dispersed in the cleaning liquid 300.

Figure 6:
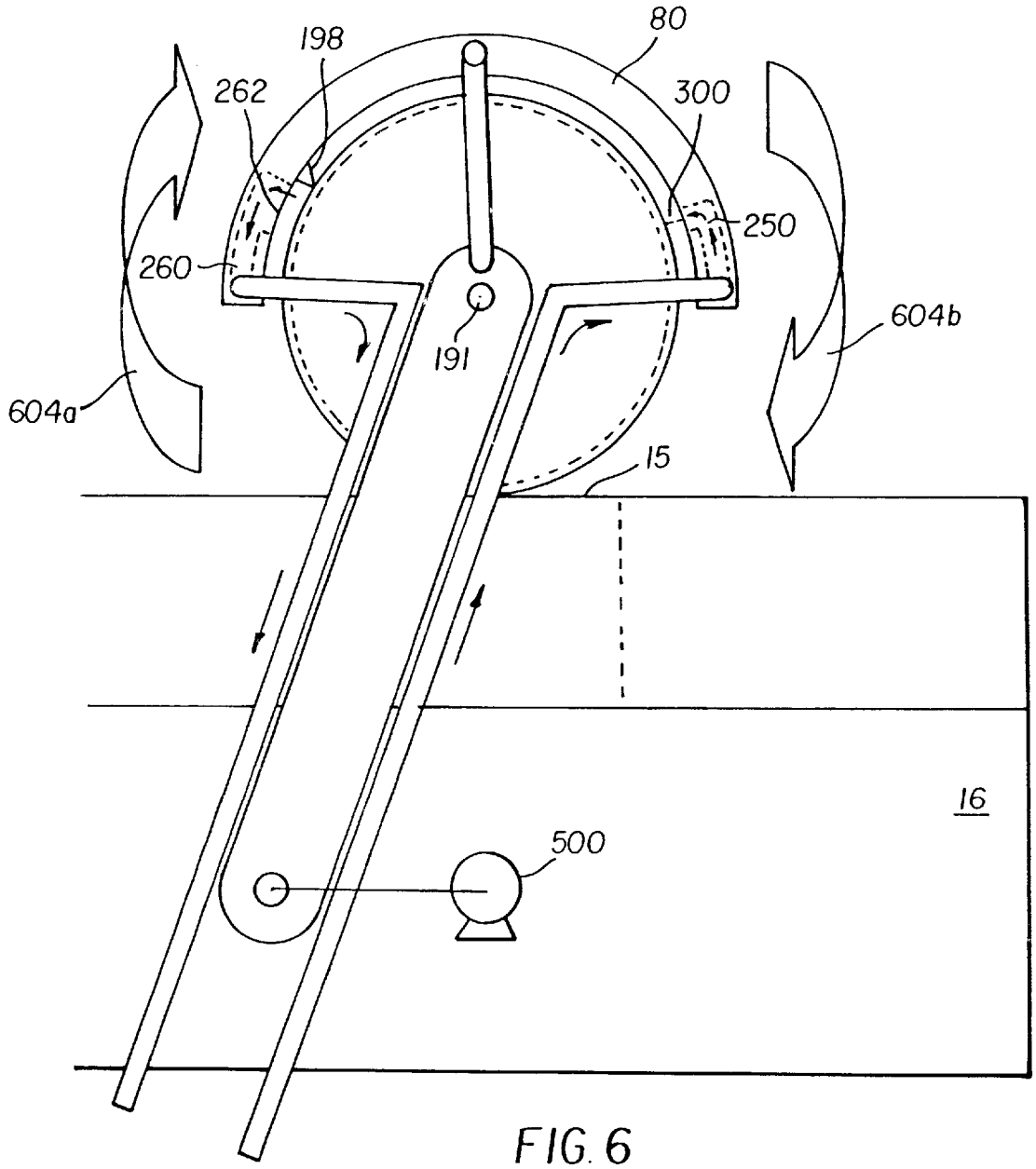
FIG. 6 is a sectional view of a roller-cleaning assembly having a canopy, a roller and rotating shaft for removing contaminant from a print head surface, in accordance with a preferred embodiment of the present invention.

To better understand the implementation of a print head cleaning assembly 32 and, in particular, the roller 190, reference is made to FIG. 6. The roller 190 is preferably coated or covered with a soft porous sponge-like material that is not abrasive to print head surface 15 and is capable of holding cleaning liquid 300 and contaminant 55. Suitable materials for the soft porous sponge-like material include polyurethane sponge or foam, expanded polytetrafluoroethylene and other similar substances. Accordingly, the roller 190 will be understood to mean a roller with a roller covering or coating consisting of a soft porous sponge-like material with such properties.

Arrows 604*a* and 604*b* indicate the motion of roller 190 when driven by a driver (not shown) integrated with and connected to rotating shaft 191, Such a driver can, in turn, be driven by a motor (also not shown). Canopy 80 is constructed with internal channels 250, 260 to supply filtered or unused cleaning liquid to the print head surface 15 and to provide suction to remove used cleaning solution. In particular, cleaning liquid 300 may be delivered through channel 250 and suction applied through channel 260 by connection to circulation pump 36 as shown in FIG. 1A and FIG. 1B. Adjacent to vacuum slot 262 is a wiper blade 198 that squeezes used cleaning liquid from roller 190. As a result of this arrangement, a flow of cleaning liquid 300 is set up on the roller 190 affording cleaning of contaminant from the print head surface 15 as well as nozzles 25. The flow of the cleaning liquid 300 may be reversed if needed by switching the channels 250 and 260 and/or by reversing the direction of rotation of roller 190.

In operation, upon receiving an electronic signal from micro-controller 24 via cleaning assembly control 40, roller 190 and cleaning liquid pump 36 are activated causing roller 190 to rotate at a predetermined rate and cleaning liquid 300 to be sprayed onto the roller 190. Micro-controller 24 also sends an electronic signal to print head transport control 42 which commands print head 16 to translate toward the roller 190 following arrow 44*a*. Preferably, the roller 190 is pre-aligned with surface 15 of print head 16 so that when print head 16 reaches roller 190, the print head surface 15 and nozzles 25 are in contact with the roller 190.

As print head 16 continues to travel along direction of arrow 44*a*, contaminant 55 on print head surface 15 and in nozzle 25 is removed by the roller 190, which is rotating and thereby cleaning the print head surface 15 and nozzles 25. Contaminated cleaning liquid on roller 190 is then squeezed from the roller 190 by blade 198 and removed by vacuum slots 262. The process of spraying cleaning solution on to roller 190 and then removing it once it has been used ensures efficient cleaning of print head surface 15 and nozzles 25. After print head surface 16 and nozzles 25 have been cleaned, print head 16 is translated back along direction of arrow 44*b* to its normal printing position. Note, that in printer systems 410 and 420, the roller 190 is preferably cantilevered. If roller 190 were supported by struts at both ends, it is possible that strut closest to gutter would collide with gutter 17 during cleaning.

As can be appreciated by those of ordinary skill, the process of engaging roller 190 with print head surface 15 described above is one of many methods of using the cleaning mechanism 190 to clean the print head surface 15 and nozzles 25. For example, rather than having print head surface 15 pre-aligned with the print head cleaning assembly 32, the print head cleaning assembly 32 may be optionally equipped with its own translation capability. By way of example only, print head cleaning assembly 32 may be supported on an elevator and lifted in direction of arrow 46*b* to the appropriate location in order to engage the roller 190 with print head surface 15. After print head surface 15 and nozzles 25 have been cleaned, the print head 16 is translated back along direction of arrow 44*b* to its normal printing position, and print head cleaning assembly 32 is lowered to its rest position along direction of arrow 46*a*.

Figure 7:
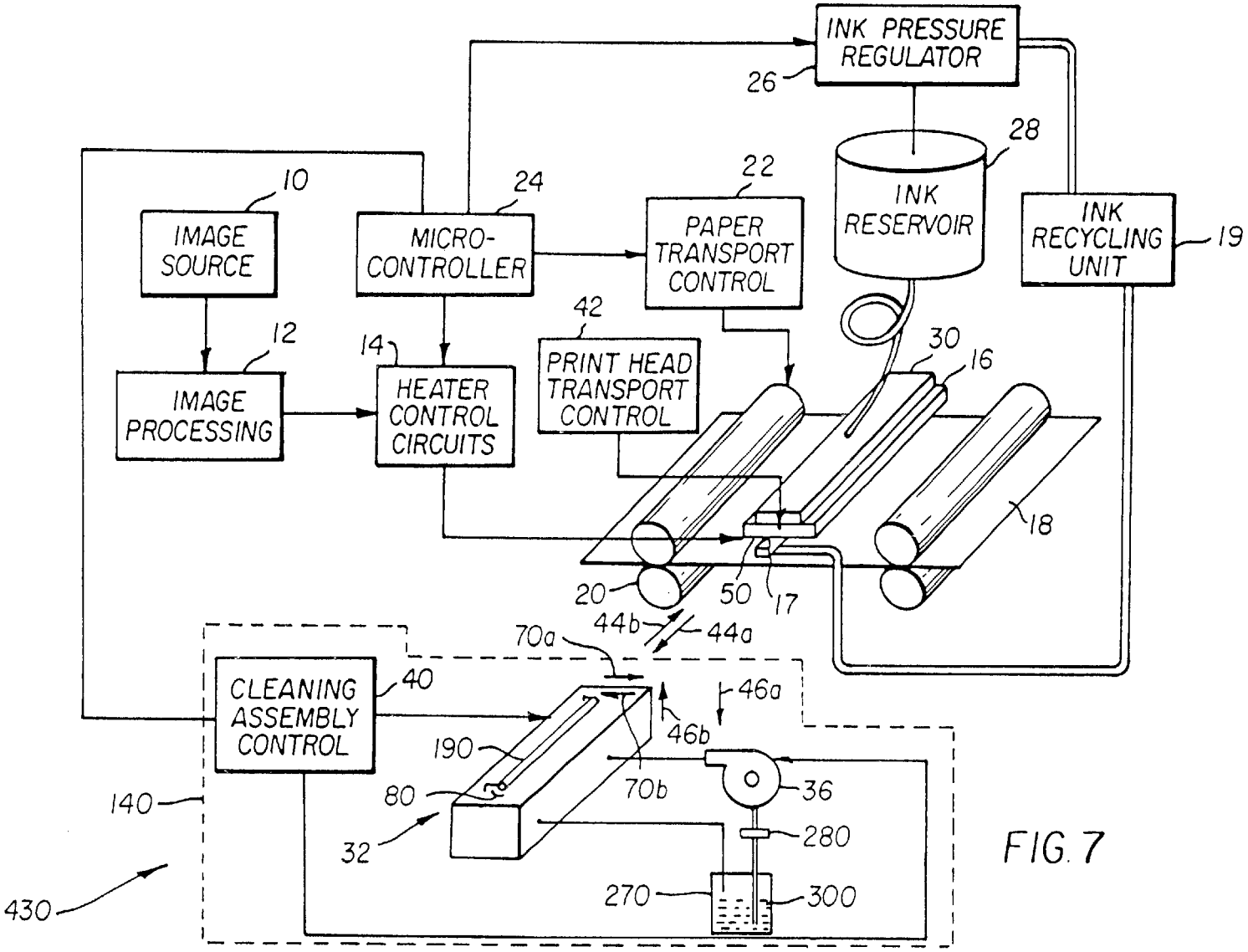
FIG. 7 shows a simplified block schematic diagram of an exemplary third embodiment printer equipped with a page width print head with fixed gutter and lengthwise roller cleaning assembly disposed adjacent to the print head.

Note that in the arrangement shown in FIGS. 1A and 1B, the roller 190 crosses one of the nozzles 25 at a time, possibly pushing contaminant 55 toward another nozzle. In order to avoid pushing contaminant 55 toward other nozzles, it is advantageous to translate the print head cleaning assembly 32 in the direction of fifth arrow 70*a* as shown in FIG. 7. Therefore, according to a third embodiment of the present invention, a self-cleaning ink jet printer system 430 is disclosed and equipped with a print head cleaning assembly 32 having a page width length roller 190 and canopy 80 that is translated in direction of fifth arrow 70*a*. Roller 190 is translated in direction 70*a* and 70*b* along a guide rail (not shown). The axis of rotation for roller 190 is parallel to the linear array of nozzles 25. As shown, roller 190 has a page width length making it suitable for use with page width ink jet print heads or a scanning type print heads.

Figure 8:
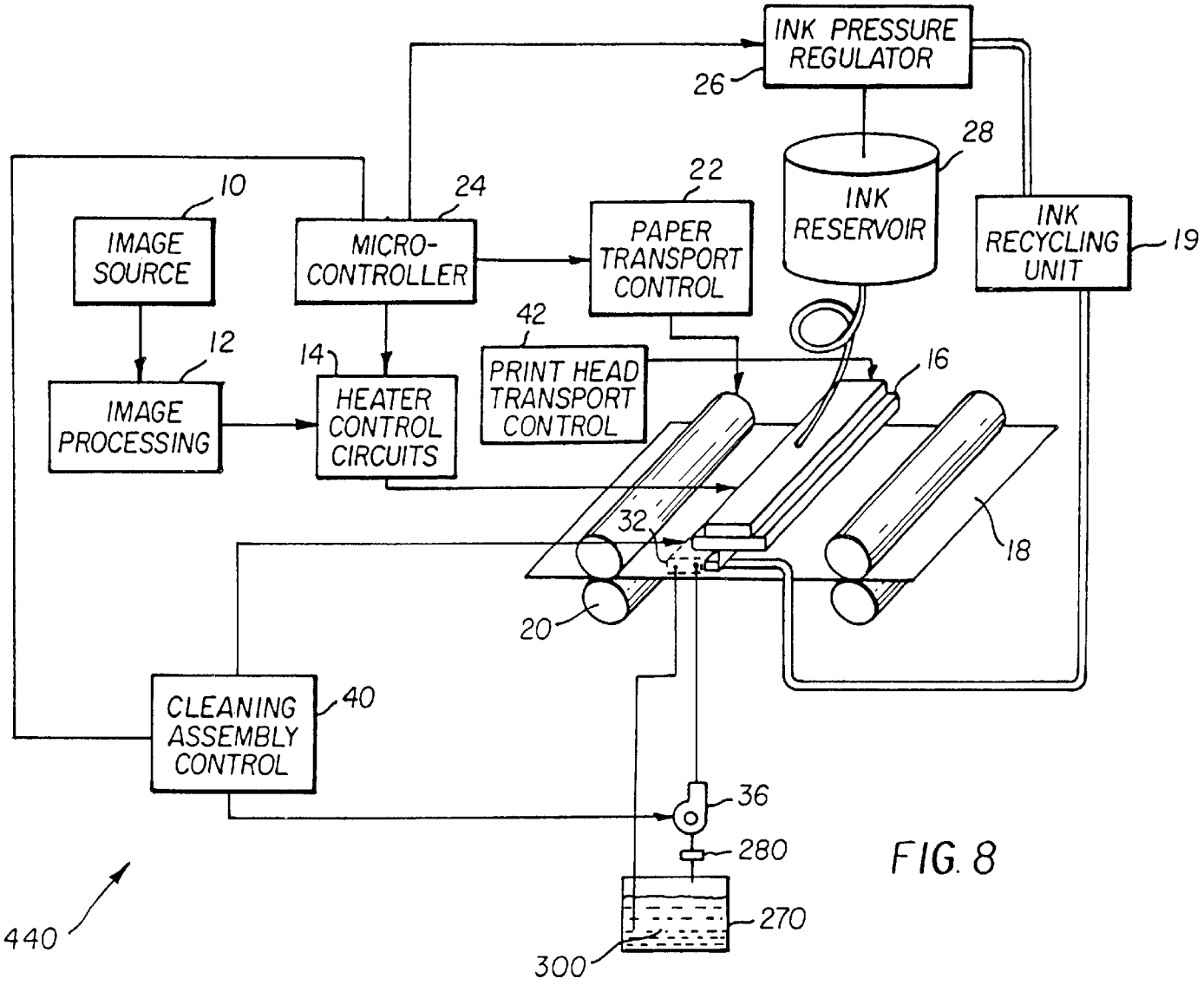
FIG. 8 shows a simplified block schematic diagram of an exemplary fourth embodiment printer equipped with a page width print head with fixed gutter and widthwise roller cleaning mechanism disposed on the same block as print head.
Figure 9:
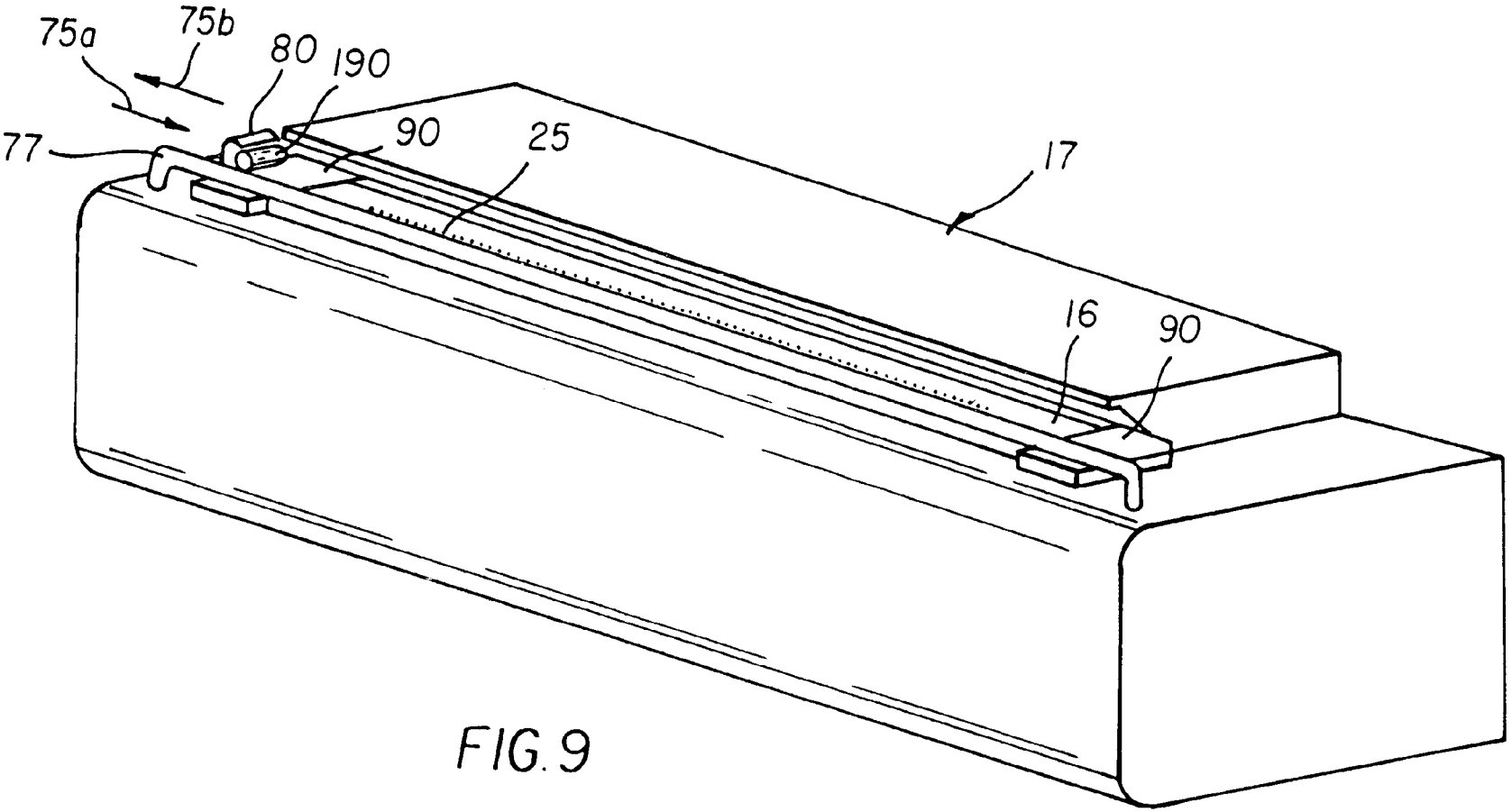
FIG. 9 shows an isometric view of print head with a roller-cleaning assembly aligned for widthwise translation.
Figure 10:
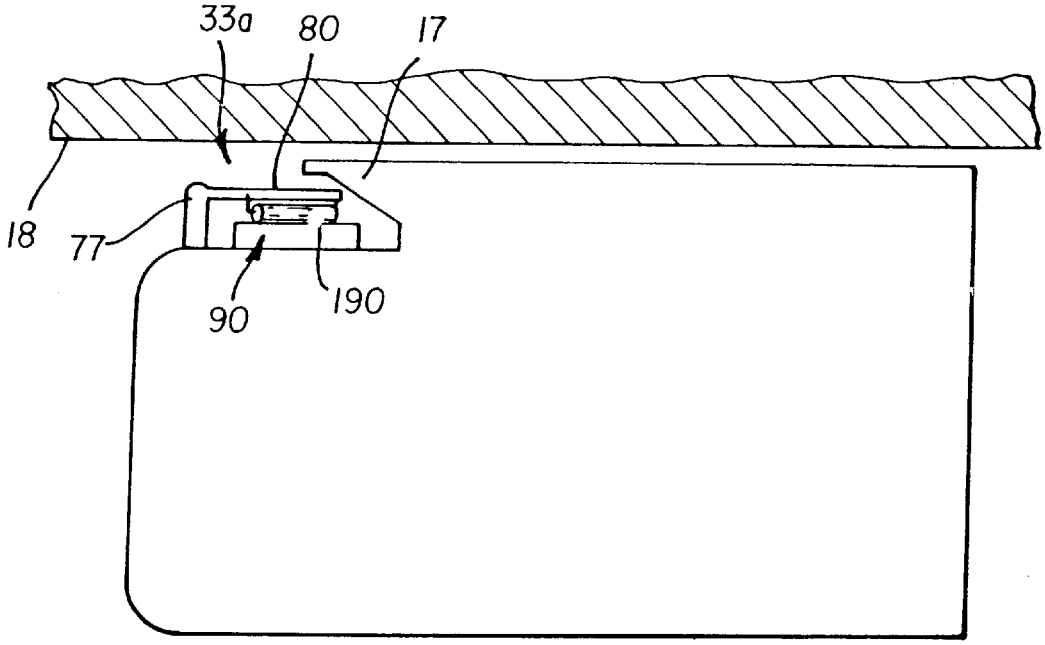
FIG. 10 shows a side view of the roller-cleaning assembly of FIG. 9 aligned for widthwise translation.

Referring to FIGS. 8, 9 and 10, therein is shown an example of a fourth embodiment self cleaning ink jet printer system, denoted generally as 440, in which a print head cleaning assembly 32 is fixed to the same block as the print head 16. In order to clean the print head surface 15, roller 190 translates along guide rail 77. As previously discussed, roller 190 is covered with roller covering and is provided with canopy 80. Canopy 80 provides means for the delivery of cleaning liquid 300 and removal of used cleaning liquid 305. A wiping pad 90 (shown in FIG. 9) is provided as an option for enhanced cleaning of the roller 190. In this way, the roller 190 can be scrubbed by the wiping pad 90 when travelling in direction of arrows 75*a* and 75*b*. In FIGS. 8, 9, and 10, the roller 190 is oriented orthogonal to the nozzles 25.

Figure 12:
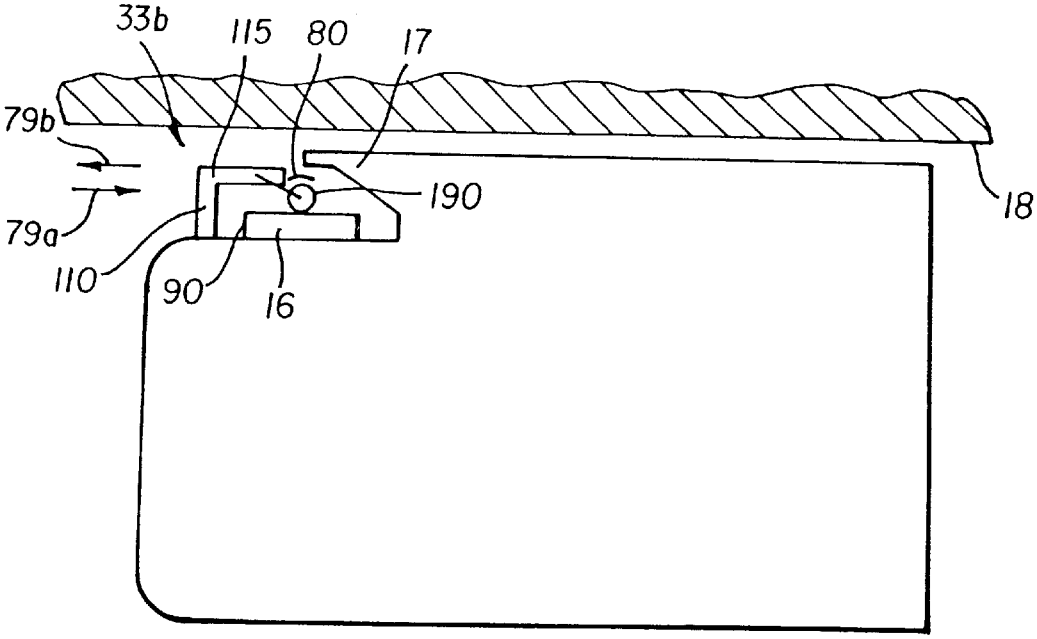
FIG. 12 shows a side view of the roller-cleaning assembly of FIG. 11.
Figure 11:
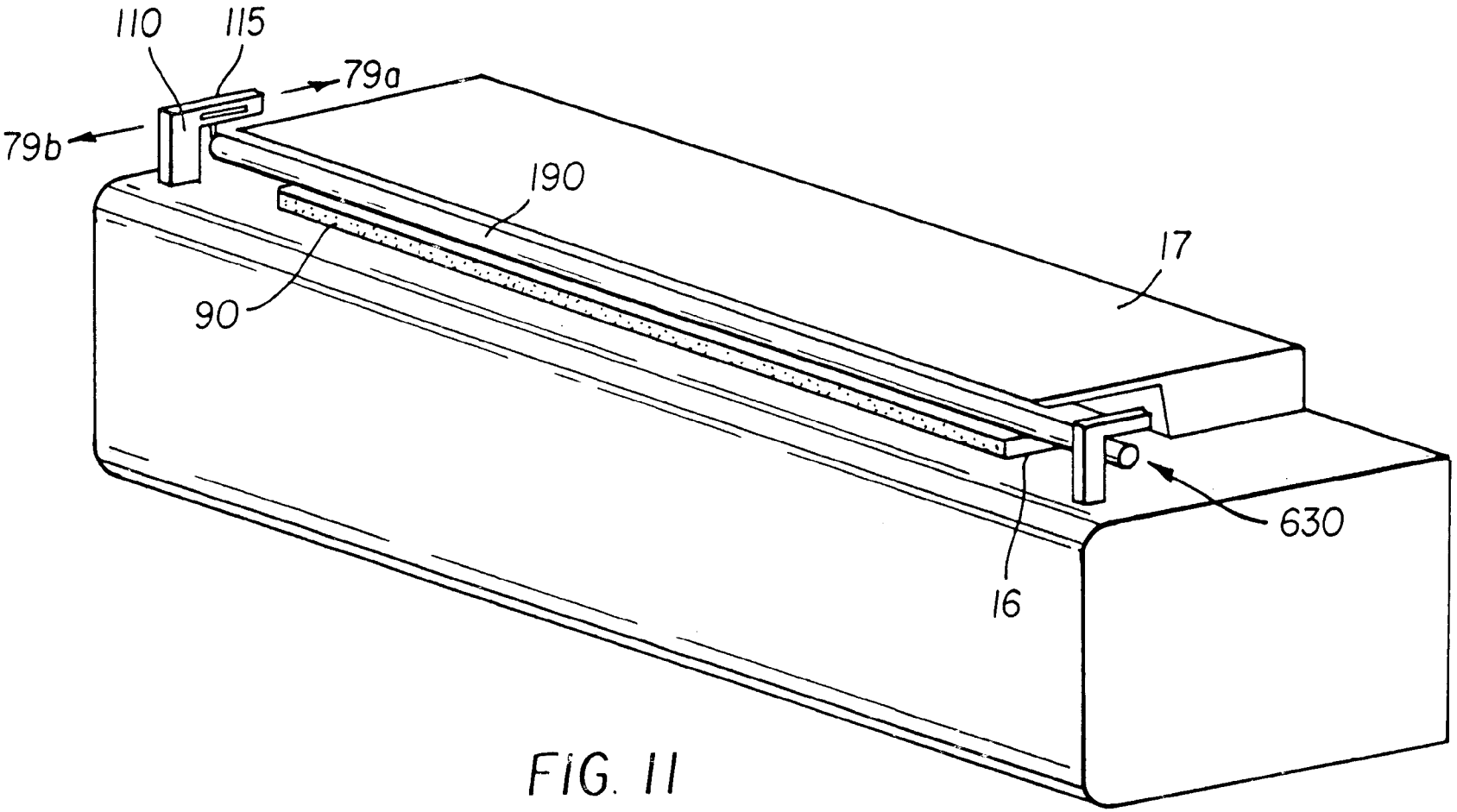
FIG. 11 an isometric view of print head with roller-cleaning assembly aligned for lengthwise translation, according to a fourth exemplary embodiment.

Referring to FIGS. 11 and 12, there is shown the self cleaning ink jet printer system 440 in which print head cleaning assembly 32 is provided on the same block of print head 16 with the roller 190 being at page width length. In particular, roller 190 is oriented along the axis of rotation parallel to nozzles 25 and incorporated on same block as print head 16. In order to clean the print head surface 15, roller 190 translates along guide rail 115 extending from the frame 110. As previously discussed, the roller 190 is covered with a soft porous material and is provided with canopy 80 that facilitates cleaning of the roller 190. In FIG. 11, the roller 190 and canopy 80 are represented as 630 for purpose of clarity of illustration. A wiping pad 90 is provided as an option for enhanced cleaning of the roller 190 then permits scrubbing by the wiping pad 90 when the 190 roller travels in direction of arrows 79*a* and 79*b*.

Figure 13:
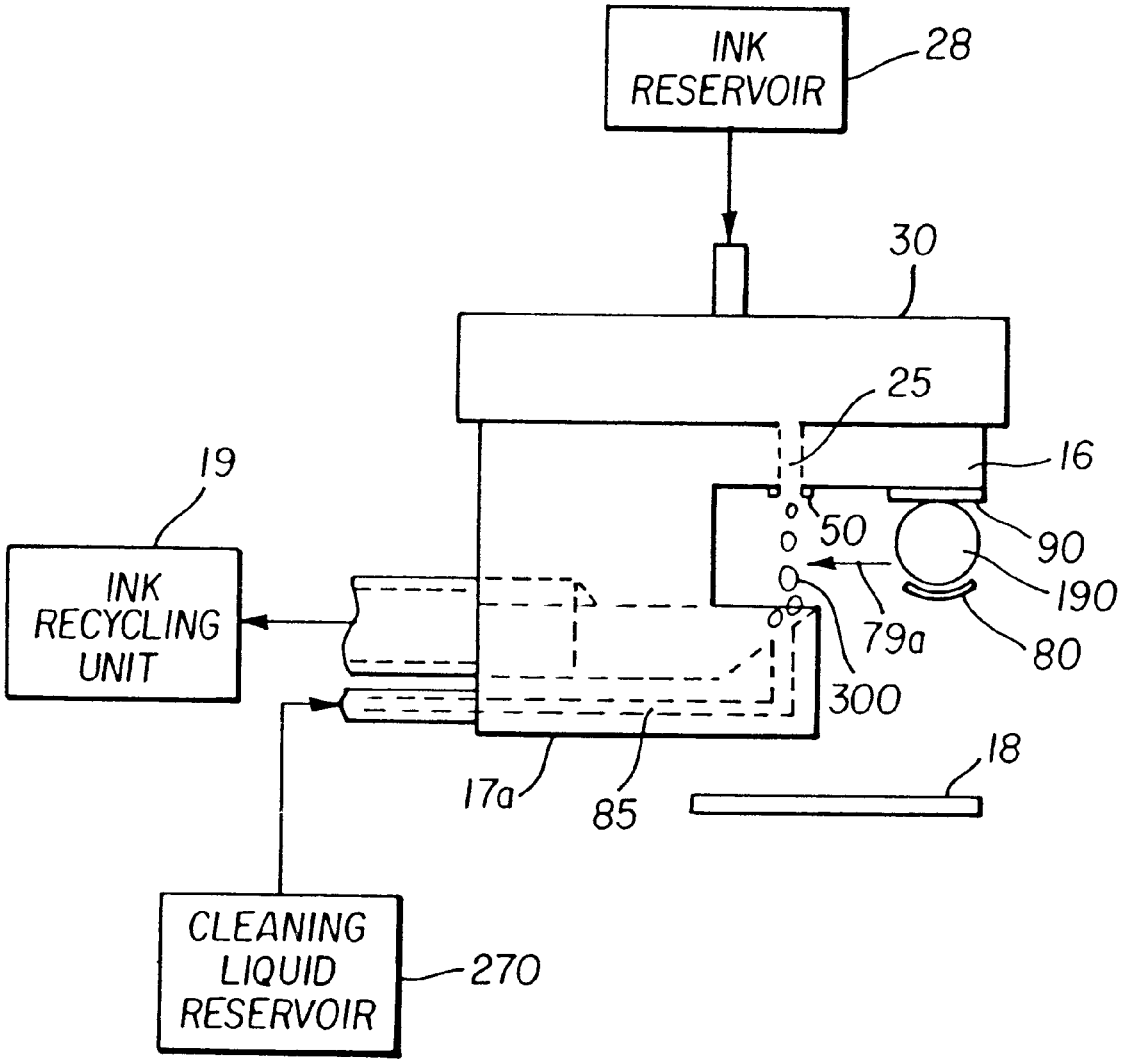
FIG. 13 is a sectional view of modified gutter delivering cleaning liquid to print head surface.

FIG. 13 illustrates how cleaning liquid 300 can be supplied to the print head surface 15 through cleaning liquid supply channel 85 in modified gutter 17*a*. In this case, when roller 190 translates in direction of arrow 79*a*, cleaning of print head surface 15 and nozzles 25 will be enhanced due to cleaning solution 300 sprayed from modified gutter 17*a* onto the roller 190. Similarly, if the cleaning solution 300 is ink, ink may be allowed to flow out of nozzle 25 onto print head surface 15 to provide cleaning solution 300 to the roller 190. In either case, excess cleaning liquid 300 on surface of roller 190 may be removed through vacuum slot 262 and by wiper blade 198 in canopy 80.

Figure 14:
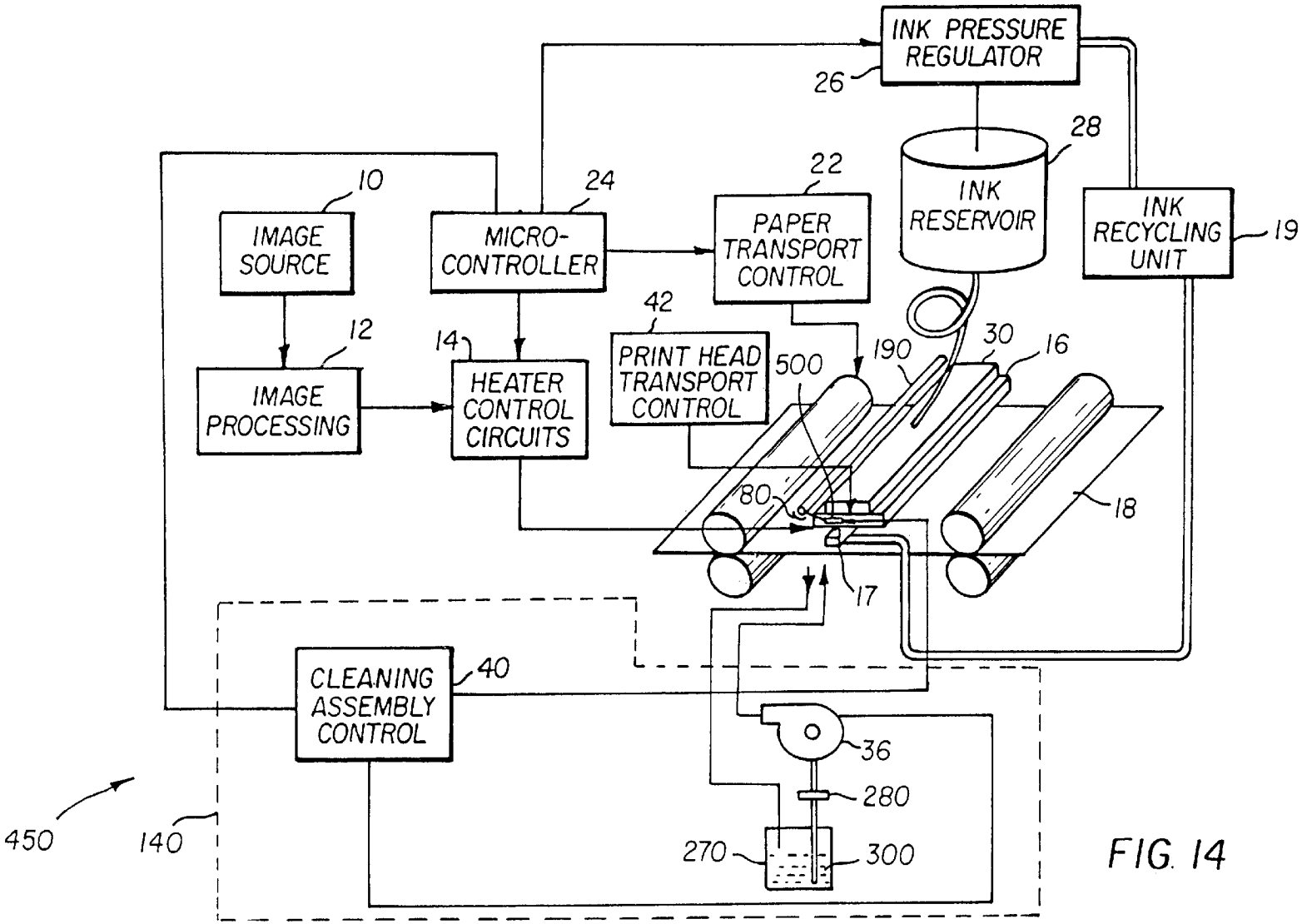
FIG. 14 shows a simplified block schematic diagram of an exemplary fifth embodiment printer equipped with a page width print head with fixed gutter and swing-arm roller mechanism disposed on the same block as the print.
Figure 15:
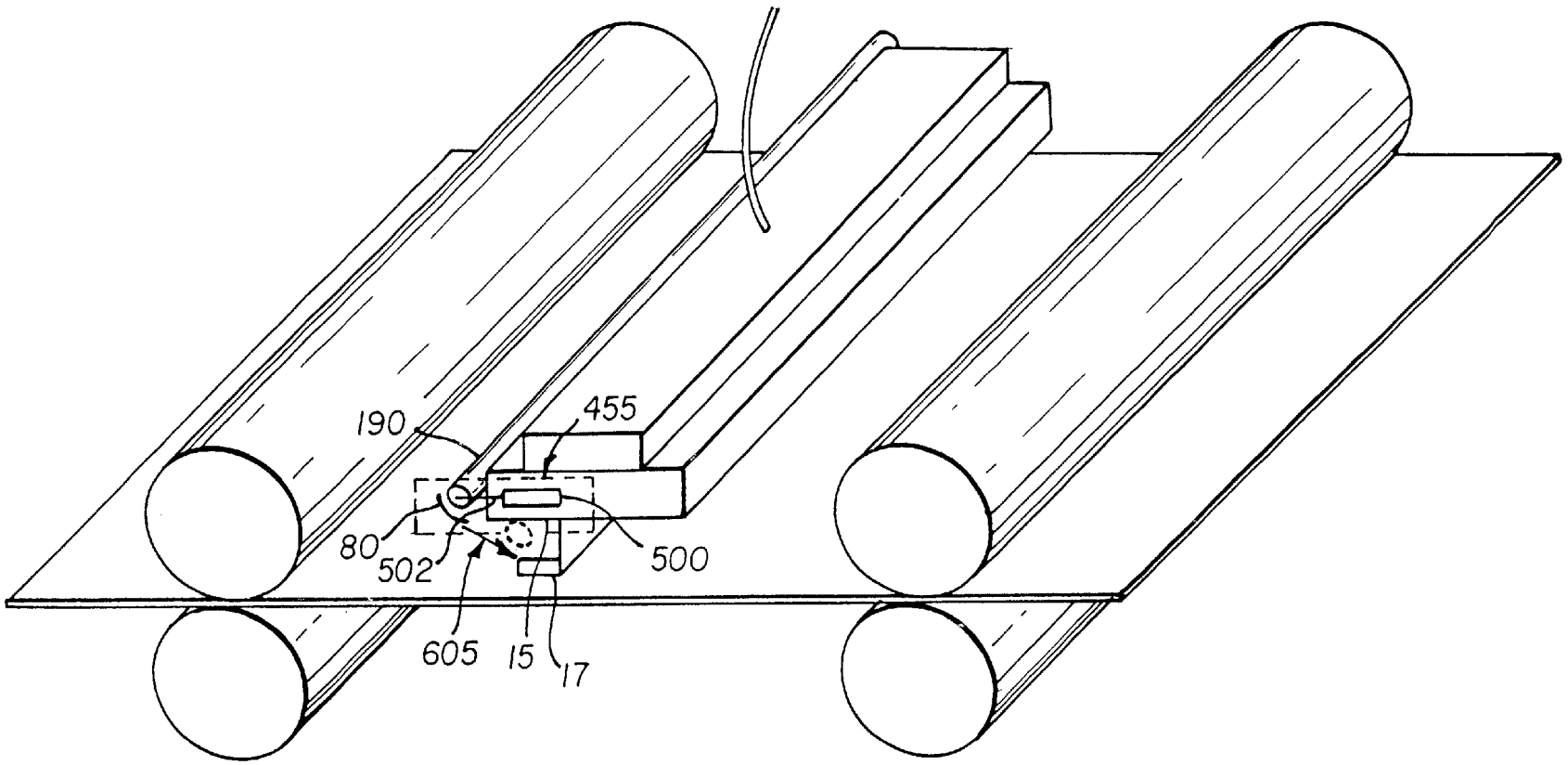
FIG. 15 shows an isometric view of a swing-arm roller-cleaning assembly positioned at rest and during cleaning.

Referring to FIGS. 14 and 15, therein is shown a fifth embodiment self-cleaning ink jet printer system 450 of the present invention in which the roller 190 contacts print head surface 15 by a swing-arm mechanism 455 during cleaning. In this regard, upon receiving electronic information from micro-controller 24 via cleaning assembly control 40, a motor 500 works with a swing-arm 502 to swing the roller 190 in direction of arrow 605 into cleaning position on print head 15.

Figure 16:
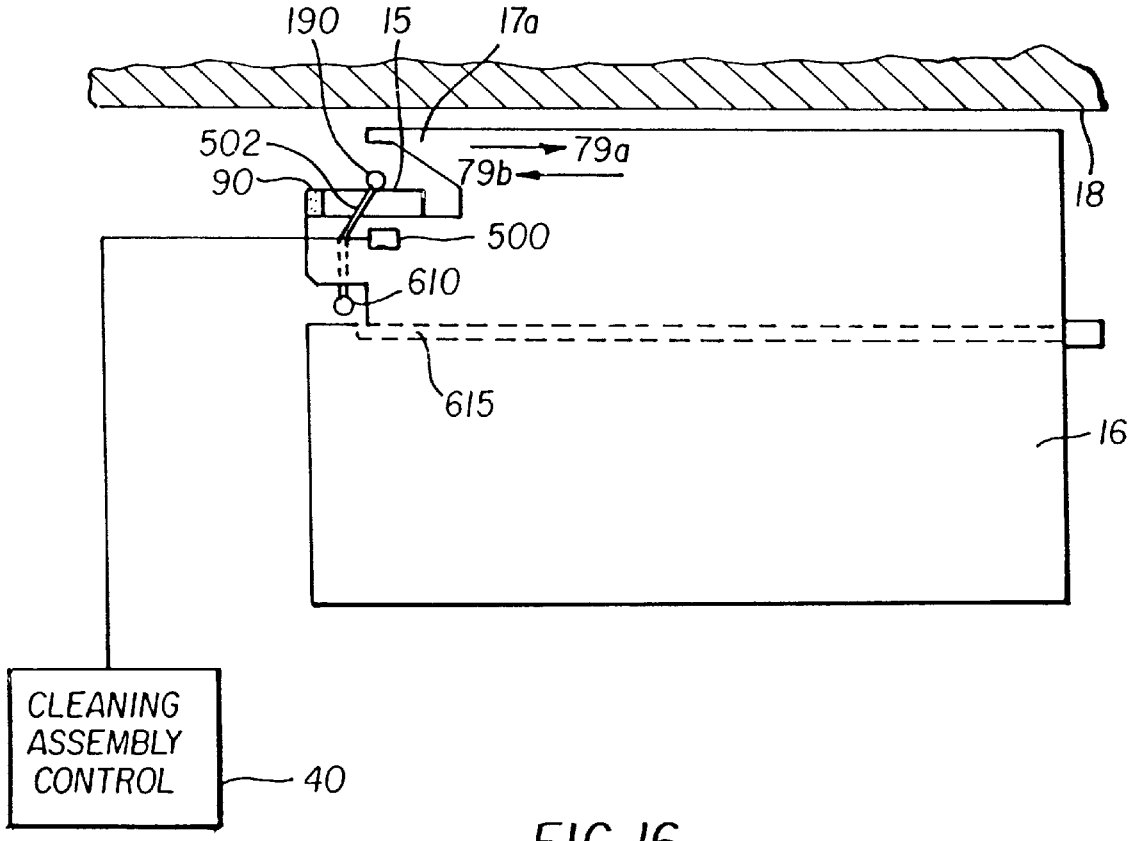
FIG. 16 shows a sectional view of an example of a swing-arm roller cleaner.
Figure 17:
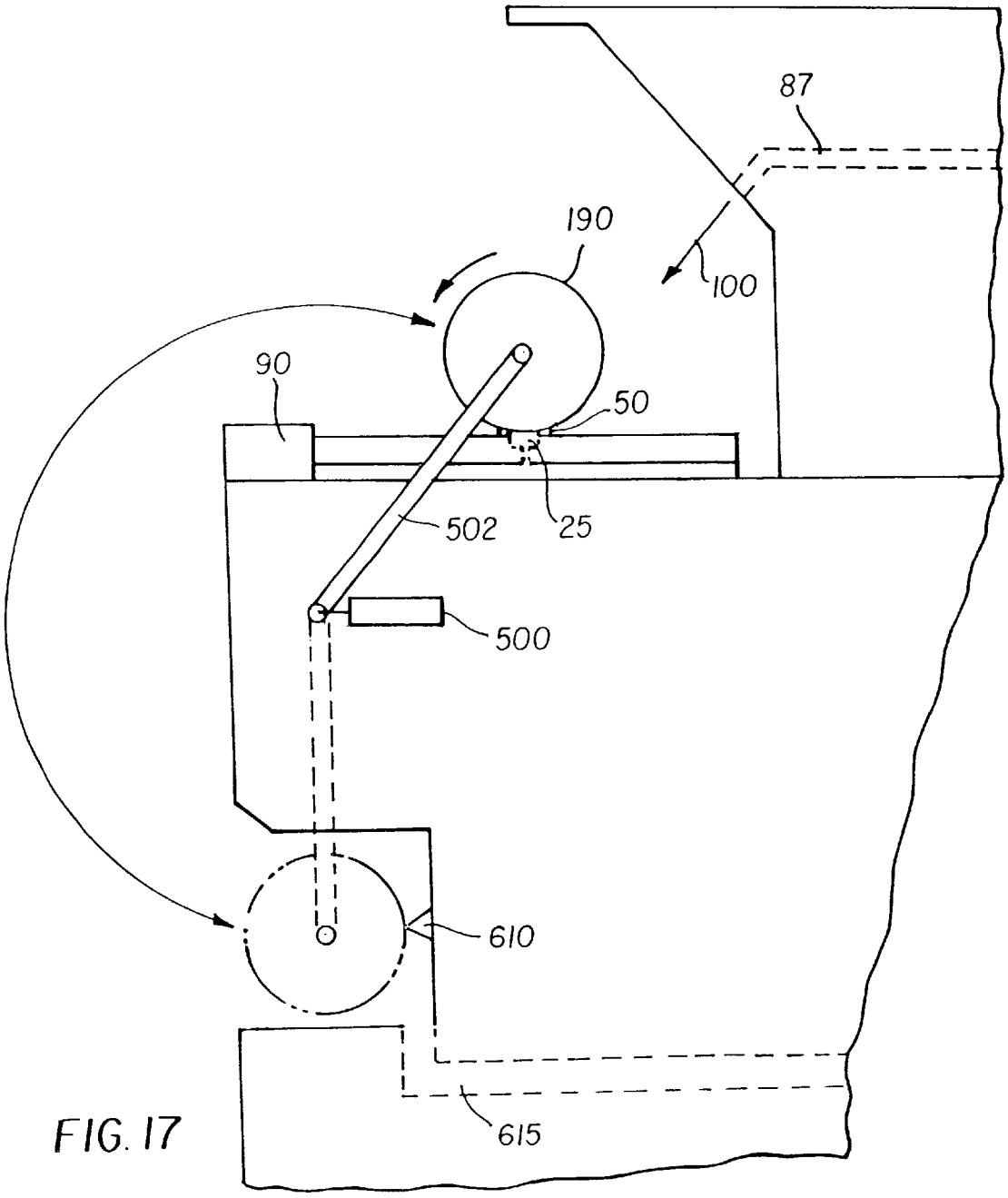
FIG. 17 shows a sectional view of an example of a swing-arm roller cleaner with air channel supply in modified gutter.
Figure 18:
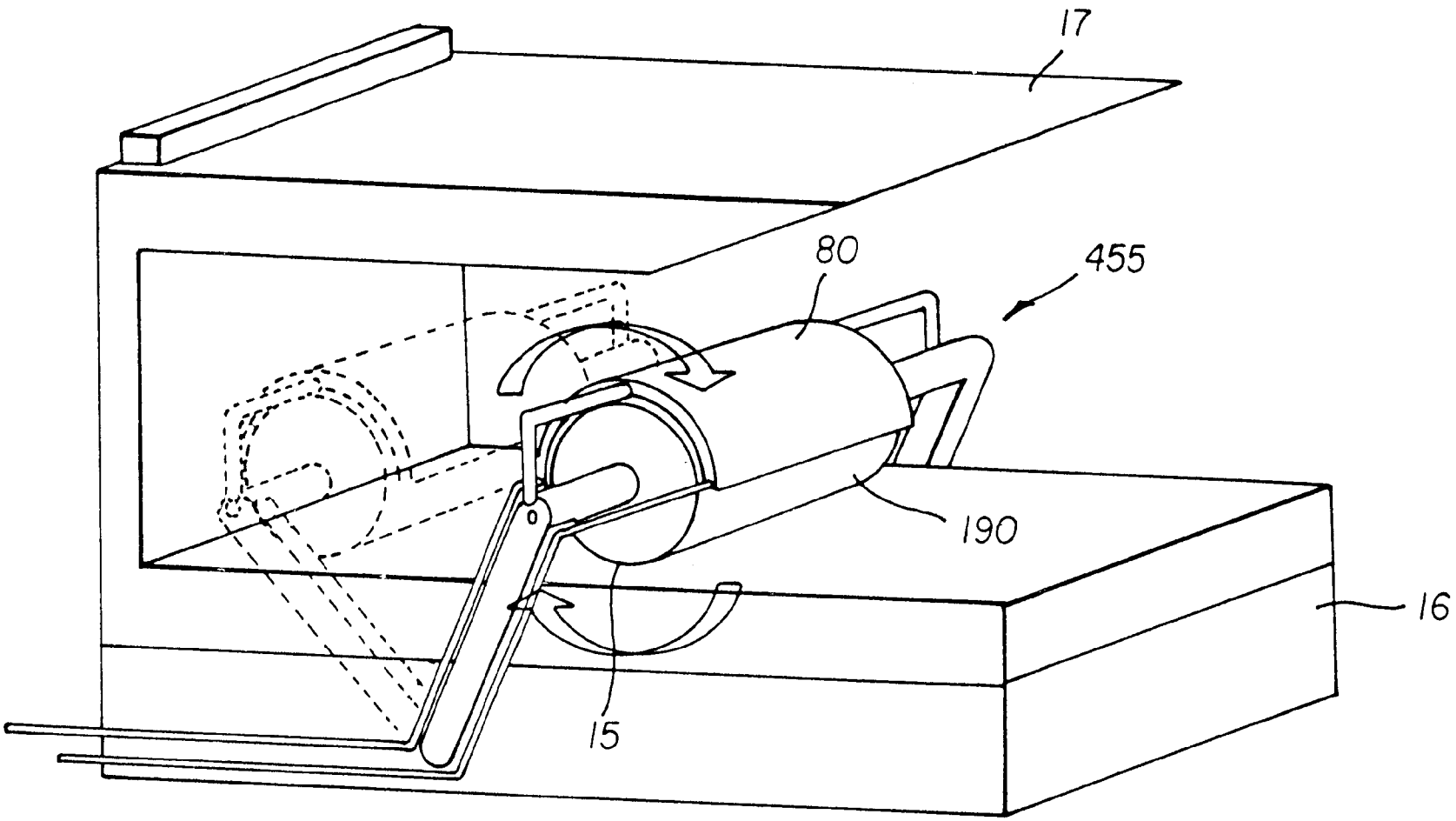
FIG. 18 shows another example of a swing-arm roller with canopy in cleaning position and in rest position.
Figure 19:
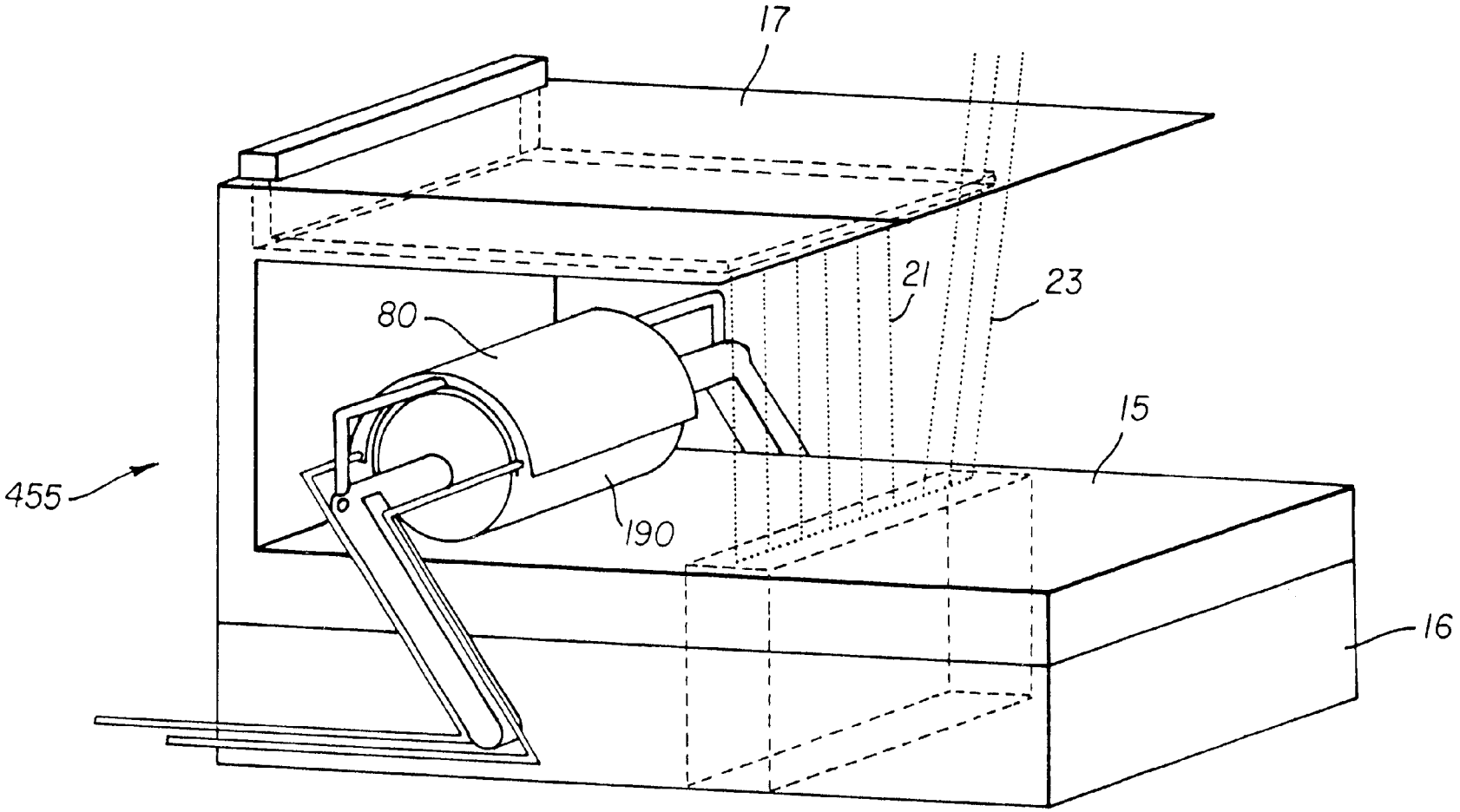
FIG. 19 shows swing-arm roller of FIG. 18 during printing operation.

There are many arrangements for configuring the motor 500 and swing arm 502 as can be appreciated by those of ordinary skill. For example, as shown in FIG. 16, the print head body 16 may be modified to provide a recess to house roller 190 in either the resting or cleaning position. During roller cleaning, the roller 190 is activated to scrape against wiper blade 610, causing used cleaning liquid 305 to be squeezed out of roller and drain into channel 615. Since ink itself can be used as a cleaner, cleaning liquid 300 may be supplied through nozzles 25 if the cleaning liquid is ink, or through modified gutter 17*a*. Optionally, as shown in FIG. 17, the modified gutter 17*a* may also be provided with air channel 87 to direct air or gas to surface 15 following the direction of arrow 100 after cleaning operation. In another example of a fifth embodiment self-cleaning ink jet printer system 450, the swing-arm roller mechanism 455 may be provided with a canopy 80 as shown in FIG. 18. FIG. 18 shows swing arm roller mechanism 455 in both the cleaning position and in rest position (shown in phantom). FIG. 19 shows, roller 190 in rest position during printing in non-deflected ink drops 21 are captured by gutter 17 and deflected drops 23 proceed to mark a recording medium (not shown).

Figure 20:
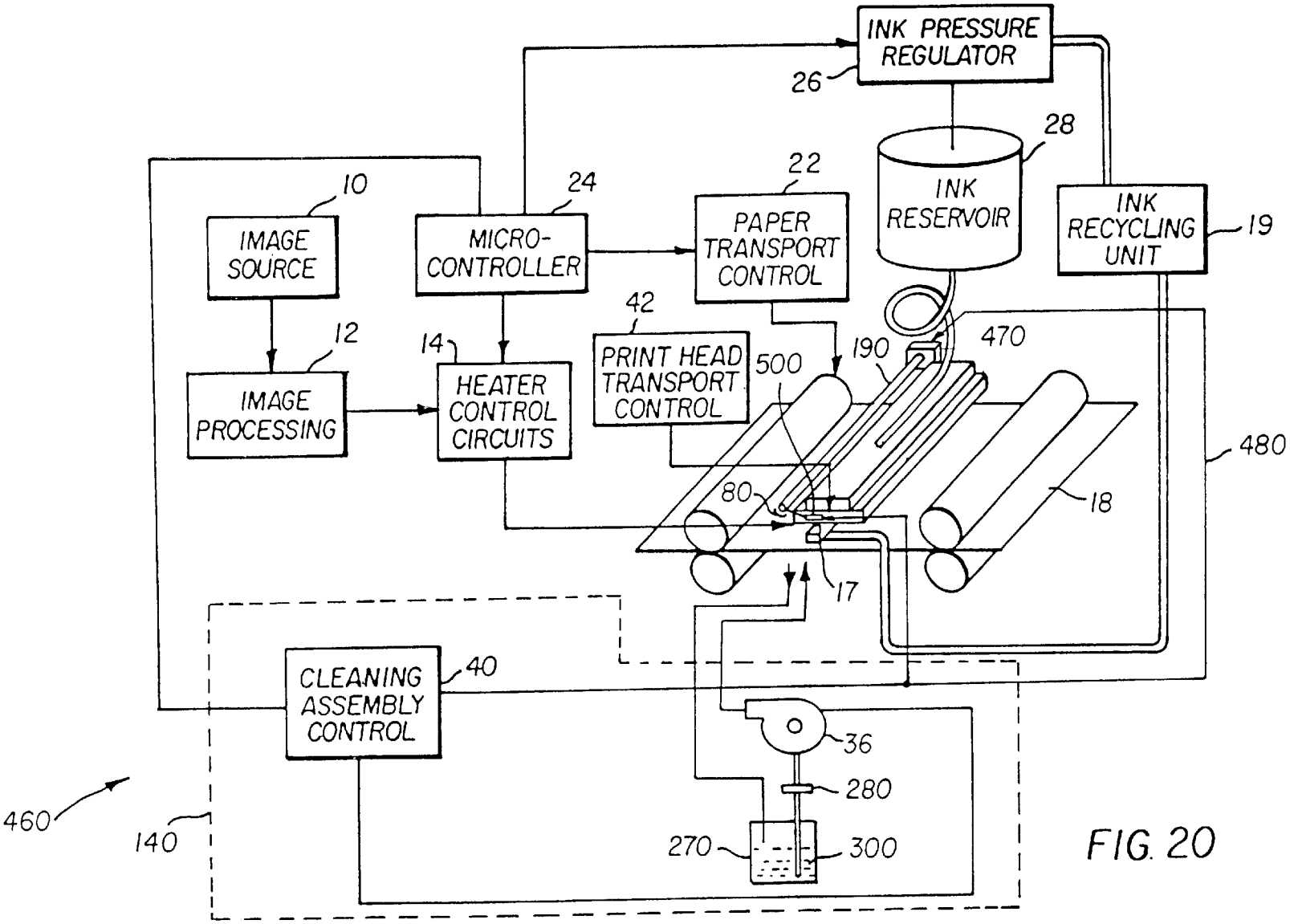
FIG. 20 shows a simplified block schematic diagram of an exemplary sixth embodiment printer equipped with a page width print head with fixed gutter and cleaning mechanism disposed on same block as print head using an ultrasonic transducer coupled to the roller-cleaning assembly.

Referring to FIG. 20 therein is shown an example of a sixth embodiment of the ink jet printer system 460 capable of simultaneously removing contaminant 55 from print head surface 15 and nozzles 25. Sixth embodiment ink jet printer 460 is substantially similar to first, second, third, fourth and fifth embodiment ink jet printer systems 410, 420, 430, 440 and 450, respectively, except that the roller 190 is vibrated by an ultrasonic transducer 470. Electrical signals and power from cleaning assembly control 40 is delivered ultrasonic transducer 470 through electrical conduit 480. Obviously, the transducer 470 may be coupled with the roller 190 in a variety of ways, although only one example is shown in FIG. 20. Furthermore, ultrasonic transducer 470 may be coupled to cleaning liquid supply 270 to energize the cleaning liquid 300 for enhanced cleaning of print head surface 15 and nozzles 25.

Therefore, what is provided and disclosed are variations and embodiments of self-cleaning printer system 410, 420, 430, 440, 450 and 460 with a corresponding cleaning mechanism 140 including variations of a print head cleaning assembly 32 with one or more versions of a roller 190 providing a mechanism and method of assembling corresponding self-cleaning printers with a cleaning mechanism 140 capable of cleaning the print head surface 15 and nozzles 25 of the printer.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention.

PARTS LIST

10 . . . image source
12 . . . image processing unit
14 . . . heater control circuits
15 . . . front surface
16 . . . print head
17 . . . gutter
17*a* . . . modified gutter
18 . . . recording medium
19 . . . ink recycling unit
20 . . . recording medium transport system
21 . . . non-deflected ink drop
22 . . . recording medium transport control system
23 . . . deflected ink drop
24 . . . micro-controller
25 . . . nozzle
26 . . . ink pressure regulator
28 . . . ink reservoir
29 . . . ink
30 . . . ink channel device
31 . . . ink channel
32 . . . print head cleaning assembly
36 . . . circulation pump
38 . . . piping
40 . . . cleaning assembly control
42 . . . print head transport control
44*a* . . . first arrow
44*b* . . . second arrow
46*a* . . . third arrow
46*b* . . . fourth arrow
50 . . . nozzle heaters
55 . . . contaminant
60 . . . ink droplet
63 . . . first axis
65 . . . second axis
66 . . . third axis
70*a* . . . fifth arrow
70*b* . . . sixth arrow
75*a* . . . seventh arrow
75*b* . . . eighth arrow
77 . . . guide rail
79*a* . . . ninth arrow
79*b* . . . tenth arrow
80 . . . canopy
85 . . . cleaning liquid supply channel in modified gutter
87 . . . air channel in modified gutter 17*a*
90 . . . wiping pad
100 . . . arrow for air flow in 450
110 . . . frame
115 . . . guide rail
140 . . . cleaning mechanism
190 . . . roller
191 . . . rotating shaft
198 . . . blade
250 . . . cleaning liquid channel in canopy
260 . . . suction channel in canopy
262 . . . vacuum slot in canopy 80
270 . . . cleaning liquid reservoir
280 . . . filter
300 . . . cleaning liquid
305 . . . used cleaning liquid
410 . . . first embodiment printer system
420 . . . second embodiment printer system
430 . . . third embodiment printer system
440 . . . fourth embodiment printer system
450 . . . fifth embodiment printer system
455 . . . swing arm mechanism
460 . . . sixth embodiment printer system with ultrasonic transducer
470 . . . ultrasonic transducer
480 . . . electrical conduit
500 . . . motor to drive swing-arm roller
502 . . . swing arm
604*a* . . . arrow
604*b* . . . arrow
605 . . . arrow
610 . . . wiper blade in fifth embodiment self-cleaning printer

615 . . . channel

630 . . . cobination of roller 190, roller covering 195 and canopy 80

What is claimed is:

1. A self-cleaning ink jet printer, comprising:

(a) a print head having a surface thereon;

(b) an ink reservoir containing ink;

(c) a gutter integrally connected to said print head for intercepting said ink in a non-printing mode; and (d) a cleaning mechanism for cleaning said print head surface, said cleaning mechanism further comprises a print head cleaning assembly to clean said surface of said print head.

2. The ink jet printer of claim 1 wherein said print head cleaning assembly further comprises:

(a) a rotating shaft surrounded by a soft covering for coming into direct sliding contact with said print head surface and removing contaminants from said print head surface; and (b) a driver for moving and connecting said rotating shaft to said print head cleaning assembly; and (c) a motor for driving said driver.

3. The ink jet printer of claim 2 wherein said rotating shaft and said soft covering comprise a roller which removes contaminants from said print head surface using back and forth contact action with said print head surface.

4. The ink jet printer of claim 3 wherein said soft covering is comprised of a porous sponge-like material.

5. The ink jet printer of claim 3 wherein said print head cleaning assembly further comprises a canopy having a channel for delivery and a channel for vacuum suction of a cleaning liquid.

6. The ink jet printer of claim 5 wherein said canopy is mounted on said print head cleaning assembly to form a gap between said roller and said canopy to facilitate delivery and suction of said cleaning liquid.

7. The ink jet printer of claim 5 wherein said print head cleaning assembly further comprises:

(a) a filter for removing contaminants from used cleaning liquid returned through said vacuum suction of said canopy;

(b) a vacuum pump to provide suctioning of used cleaning liquid from said roller; and (c) a liquid reservoir;

wherein said cleaning liquid is delivered to said print head surface by said channel for delivery in said canopy and suctioned back through said channel for vacuum suction to said filter whereby said contaminants are removed from said cleaning liquid returned through said channel for vacuum suction before being discharged to said liquid reservoir to be dispensed back through said channel for delivery of said canopy.

8. A cleaning mechanism for an ink jet printer with a print head having a surface containing a plurality of nozzles therein, said printer having a gutter integrally connected to said print head for intercepting ink in a non-printing mode, said cleaning mechanism comprising;

(a) a print head cleaning assembly including a roller for cleaning said print head surface;

(b) a means for moving, positioning, and aligning said roller;

(c) a canopy for facilitating flow of a cleaning liquid to said print head surface;

(d) a means for delivery of said cleaning liquid;

(e) a means for vacuum suction of said cleaning liquid;

(f) a filter for removing contaminants from said liquid returned through said vacuum suction of said canopy;

(g) a vacuum pump to provide suctioning of said liquid; and (h) a liquid reservoir wherein said cleaning liquid is delivered to said print head surface by said means for delivery and suctioned back through said means for suction to said filter whereby said contaminants are removed from said cleaning liquid returned through said means for suction before being discharged to said liquid reservoir to be dispensed back through said means for delivery.

9. The cleaning mechanism of claim 8 wherein said roller further comprises:

(a) a rotating shaft surrounded by a soft covering for coming into direct sliding contact with said print head surface and removing contaminants from said print head surface; and (b) a driver for moving and connecting said rotating shaft to said cleaning assembly; and (c) a motor for driving said driver.

10. The cleaning mechanism of claim 8 wherein said canopy further comprises channels for delivery and suction of said cleaning liquid, said canopy channels positioned to align with said means for delivery and suction of said cleaning system to facilitate transmission of liquid to said surface.

11. The cleaning mechanism of claim 8 wherein said means for delivery of said cleaning liquid is located in said gutter.

12. The cleaning mechanism of claim 8 wherein said canopy is adapted to contain said means for suction of said cleaning liquid.

13. The cleaning mechanism of claim 9 wherein said soft covering comprises a porous sponge-like material.

14. The cleaning mechanism of claim 8 further comprising a a pressure regulator for delivering said cleaning liquid through said nozzles.

15. A print head cleaning assembly for a self-cleaning ink jet printer with a print head having surface containing a plurality of nozzles therein, said printer having a gutter integrally connected to said print head for intercepting ink flowing through said nozzles in a non-printing mode, the printer further giving a mounting block for supporting said print head cleaning assembly, said assembly comprising:

(a) a roller for cleaning said print head surface;

(c) a canopy attached to said roller and having a delivery channel and a vacuum channel for delivery and vacuum suction, respectively, of a cleaning liquid;

wherein said cleaning liquid can be delivered to said print head surface via said roller via said delivery channel in said canopy and suctioned back through via said vacuum channel so that contaminants are removed from said print head surface as said roller is moved about said print head surface.

16. The print head cleaning assembly of claim 15 further comprising a filter attached to said canopy and adapted for removing contaminants from said liquid returned through said vacuum suction of said canopy.

17. The print head cleaning assembly of claim 16 further comprising a vacuum pump coupled to said vacuum channel and adapted to provide suctioning of said cleaning liquid.

18. The print head cleaning assembly of claim 15 wherein said roller further comprises:

(a) a rotating shaft for moving and connecting said roller to said canopy; and (b) a soft covering surrounding said rotating shaft that upon contact with said print head surface cleans contaminants from said print head surface.

19. The print head cleaning assembly of claim 15 further comprising a means for moving, positioning, and aligning said roller.

20. The print head cleaning assembly of claim 19 wherein said means for moving, positioning and aligning said roller further comprises a mechanism for lifting and translating said roller across said print head.

21. The print head cleaning assembly of claim 19 wherein said means for moving, positioning, and aligning is configured to move said roller along the y-axis of said print head to effectuate cleaning.

22. The print head cleaning assembly of claim 18 further comprising:

(a) a driver connected to said rotating shaft; and (b) a motor connected to said driver and configured to cause the rotating action of said rotating shaft.

23. The print head cleaning assembly of claim 15 further comprising an ultrasonic transducer coupled to said roller for causing its vibration about said print head surface.

24. The print head cleaning assembly of claim 15 wherein said canopy is mounted adjacent to said print head on said mounting block.

25. The print head cleaning assembly of claim 15 wherein said roller and said canopy are at least equal in length to said print head.

26. The print head cleaning assembly of claim 15 further comprising a swing-arm mechanism configured to secure said roller to said mounting block.

27. The print head cleaning assembly of claim 26 wherein said swing-arm mechanism further includes:

(a) a swing-arm with a first end connected to said roller and a second end; and (b) a motor coupled to said second end of said swing-arm and adapted to rotate said roller from a printing position to a cleaning position.

28. In a self-cleaning printer, a method for cleaning an ink jet printer head having a print head surface thereon, said inkjet printer including a fixed gutter assembly, a print head cleaning assembly including a roller for removing contaminants from said surface and a controller, said method comprising the steps of:

(a) receiving an electric signal indicating a maintenance mode from said controller;

(b) translating said print head to pre-defined maintenance position;

(c) translating said print head cleaning assembly from a predefined home position to a cleaning position;

(d) conducting a cleaning cycle comprising moving said roller in said cleaning position wherein said roller comes in contact with said print head surface;

(e) cleaning said roller;

(f) translating said print head cleaning assembly from said cleaning position to said home position; and (g) translating said print head to a pre-defined printing position.

29. The method of cleaning an inkjet printer head according to claim 28 further comprising the step of rotating said roller at a pre-determined speed and for a pre-determined distance from said print head surface.

* * * * *